US010739033B2

(12) United States Patent
Tezuka et al.

(10) Patent No.: US 10,739,033 B2
(45) Date of Patent: Aug. 11, 2020

(54) AIR-CONDITIONING APPARATUS

(71) Applicant: Mitsubishi Electric Corporation, Tokyo (JP)

(72) Inventors: Motoshi Tezuka, Tokyo (JP); Daisuke Sugiyama, Tokyo (JP); Tatsuo Seki, Tokyo (JP); Hideki Takahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 292 days.

(21) Appl. No.: 15/578,465

(22) PCT Filed: Aug. 6, 2015

(86) PCT No.: PCT/JP2015/072412
§ 371 (c)(1),
(2) Date: Nov. 30, 2017

(87) PCT Pub. No.: WO2017/022132
PCT Pub. Date: Feb. 9, 2017

(65) Prior Publication Data

US 2018/0119983 A1 May 3, 2018

(51) Int. Cl.
*F24F 13/15* (2006.01)
*F24F 13/08* (2006.01)
(Continued)

(52) U.S. Cl.
CPC ..... *F24F 13/08* (2013.01); *F24F 1/0011* (2013.01); *F24F 1/027* (2013.01); *F24F 11/79* (2018.01);
(Continued)

(58) Field of Classification Search
CPC ..... F24F 13/16; F24F 13/15; F24F 13/1413; F24F 11/56; F24F 11/0001; F24F 13/10; F24F 13/08
(Continued)

(56) References Cited

U.S. PATENT DOCUMENTS

2009/0090125 A1 4/2009 Seki
2010/0198375 A1* 8/2010 Rottler ..... G06F 3/0482 700/94
(Continued)

FOREIGN PATENT DOCUMENTS

CN 101165420 A 4/2008
EP 2 045 540 A1 4/2009
(Continued)

OTHER PUBLICATIONS

Office action dated Jul. 22, 2019 issued in corresponding CN patent application No. 201580082058.8 (and English translation thereof).
(Continued)

*Primary Examiner* — Vivek K Shirsat
*Assistant Examiner* — Ko-Wei Lin
(74) *Attorney, Agent, or Firm* — Posz Law Group, PLC

(57) ABSTRACT

An air-conditioning apparatus includes an indoor unit including a pair of lateral air-directing vanes each configured to adjust an orientation of an air flow blown from an air outlet in a lateral direction, and a remote control device configured to receive selection of at least two of a plurality of air flow directions in the lateral direction. The indoor unit includes an indoor-unit controller configured to individually adjust operations of the pair of lateral air-directing vanes in accordance with the selection of the plurality of air flow directions in the remote control device such that a left partial air flow does not collide with a right partial air flow.

8 Claims, 14 Drawing Sheets

(51) Int. Cl.

| | |
|---|---|
| ***F24F 1/0011*** | (2019.01) |
| ***F24F 11/79*** | (2018.01) |
| ***F24F 1/027*** | (2019.01) |
| *F24F 11/64* | (2018.01) |
| *F24F 11/52* | (2018.01) |
| *F24F 11/56* | (2018.01) |

(52) U.S. Cl.
CPC ..... *F24F 11/52* (2018.01); *F24F 11/56* (2018.01); *F24F 11/64* (2018.01)

(58) Field of Classification Search
USPC ..... 454/333, 335, 336
See application file for complete search history.

(56) References Cited

U.S. PATENT DOCUMENTS

| | | | | |
|---|---|---|---|---|
| 2013/0153173 | A1 | 6/2013 | Nakamura | |
| 2014/0020860 | A1* | 1/2014 | Matsumoto | F24F 1/0007 165/11.1 |
| 2016/0185182 | A1* | 6/2016 | Lee | B60H 1/00828 454/75 |

FOREIGN PATENT DOCUMENTS

| | | | |
|---|---|---|---|
| EP | 2 687 789 | A1 | 1/2014 |
| JP | H05-066043 | A | 3/1993 |
| JP | 2007-147120 | A | 6/2007 |
| JP | 2008-101894 | A | 5/2008 |
| JP | 2009-092283 | A | 4/2009 |
| JP | 2009-180460 | A | 8/2009 |
| JP | 2011-080648 | A | 4/2011 |
| JP | 2012-042138 | A | 3/2012 |
| JP | 2013-076493 | A | 4/2013 |
| JP | 2013-130323 | A | 7/2013 |

OTHER PUBLICATIONS

Office Action dated Aug. 7, 2018 issued in corresponding JP patent application No. 2017-532347 (and English translation).
Extended EP Search Report dated Mar. 15, 2019 issued in corresponding EP patent application No. 15900443.1.
International Search Report of the International Searching Authority dated Nov. 2, 2015 for the corresponding international application No. PCT/JP2015/072412 (and English translation).

* cited by examiner

AIR-CONDITIONING APPARATUS

CROSS REFERENCE TO RELATED APPLICATION

This application is a U.S. national stage application of International Application No. PCT/JP2015/072412, filed on Aug. 6, 2015, the contents of which are incorporated herein by reference.

TECHNICAL FIELD

The present invention relates to an air-conditioning apparatus including a remote control device that receives various operations.

BACKGROUND

Some air-conditioning apparatuses include an indoor unit having two separate left and right air outlets. Such a type of indoor unit includes two separate left and right vertical air-directing vanes for adjusting an air flow in the vertical direction, or a vertical air flow direction and two separate left and right lateral air-directing vanes each configured to adjust an air flow in the lateral direction, or a lateral air flow direction. The separate air-directing vanes are driven and controlled independently. Consequently, conditioned air produced by a refrigeration cycle of an air-conditioning apparatus is blown as left and right independent partial air flows from the air outlets of the indoor unit (refer to Patent Literature 1, for example).

Patent Literature

Patent Literature 1: Japanese Unexamined Patent Application Publication No. 2012-42138

However, if there is no restriction on operations of the two lateral air-directing vanes, which are independent of each other, a left partial air flow and a right partial air flow may collide with each other and a blown air flow may fail to reach a user's intended location. Furthermore, a collision between the partial air flows causes noise.

To set a lateral air flow direction in the air-conditioning apparatus disclosed in Patent Literature 1, a user selects an intended lateral air flow direction from a group of air flow graphic patterns recorded in a remote control device. At this time, the user has to press an air flow direction setting button included in the remote control device multiple times to select an air flow graphic pattern corresponding to the intended air flow direction. Each time the user changes air flow direction setting, the user has to perform a troublesome operation, thus wasting time. Furthermore, an increase in the number of air flow graphic patterns for finer air flow direction setting results in a further increase in time and effort to select an air flow graphic pattern corresponding to a user's intended air flow direction.

SUMMARY

The present invention has been made to overcome the above-described disadvantages, and aims to provide an air-conditioning apparatus that produces various air flow patterns with no collision between left and right partial air flows in accordance with simple setting, made by using a remote control device, of lateral air flow directions from an indoor unit.

An embodiment of the present invention provides an air-conditioning apparatus including an indoor unit including a pair of lateral air-directing vanes each configured to adjust an orientation of an air flow blown from an air outlet in a lateral direction, and a remote control device configured to receive selection of at least two of a plurality of air flow directions in the lateral direction. The indoor unit includes an indoor-unit controller configured to individually adjust operations of the pair of lateral air-directing vanes in accordance with the selection of the plurality of air flow directions in the remote control device such that a partial air flow blown through one of the pair of lateral air-directing vanes that is arranged on a left side in a front view does not collide with a partial air flow blown through another one of the pair of lateral air-directing vanes that is arranged on a right side in the front view.

According to an embodiment of the present invention, the remote control device receives selection of at least two of the plurality of air flow directions in the lateral direction, the at least two of the plurality of air flow directions including double selection of at least two of the same one of the plurality of air flow directions. The indoor-unit controller configured to adjust the operations of the pair of lateral air-directing vanes in accordance with the selection of the air flow directions or direction in the remote control device such that a left partial air flow does not collide with a right partial air flow. Consequently, various air flow patterns with no collision between left and right partial air flows can be produced on the basis of simple setting, made by using the remote control device, of lateral air flow directions from the indoor unit.

DETAILED DESCRIPTION

Embodiment 1

Figure 1:
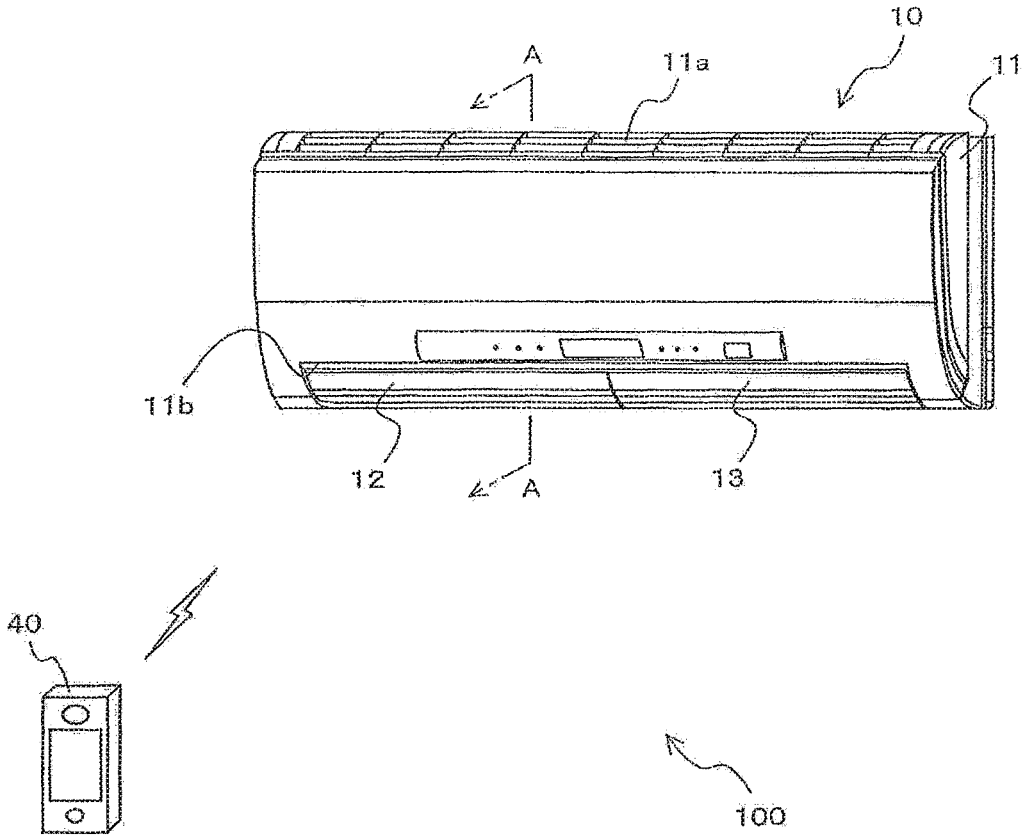
FIG. 1 is a front perspective view illustrating an indoor unit and a remote control device included in an air-conditioning apparatus according to Embodiment 1 of the present invention as viewed from the right side of the unit and the device.
Figure 2:
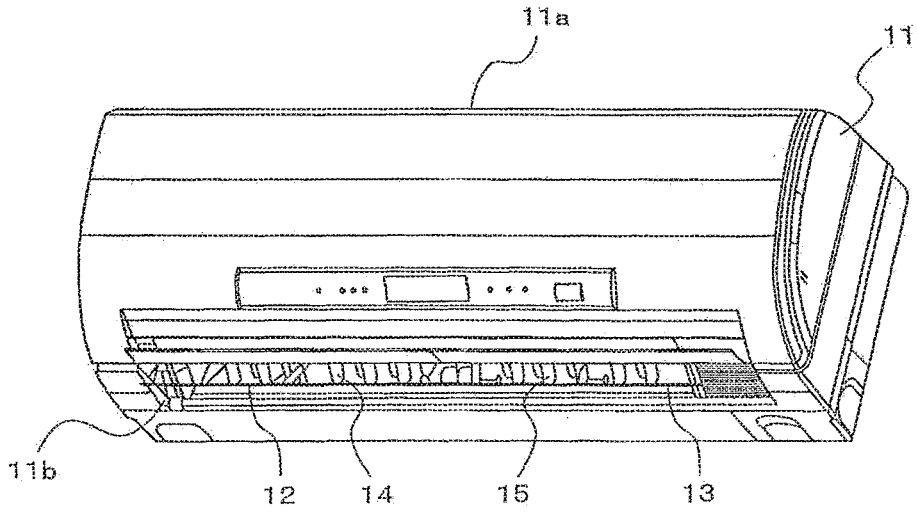
FIG. 2 is a perspective view of the indoor unit in FIG. 1 viewed from below on the right side of the unit.

FIG. 1 is a front perspective view illustrating an indoor unit and a remote control device included in an air-conditioning apparatus according to Embodiment 1 of the present invention as viewed from the right side of the unit and the device. FIG. 2 is a perspective view of the indoor unit in FIG. 1 as viewed from below on the right side of the unit. As illustrated in FIG. 1, the air-conditioning apparatus 100, according to Embodiment 1 includes the indoor unit 10, and the remote control device 40. The indoor unit 10 is connected to the remote control device 40 in a wired or wireless manner for data communication.

As illustrated in FIGS. 1 and 2, the indoor unit 10 includes a box-shaped casing 11. The casing 11 has, in its upper surface, an air inlet 11*a* through which indoor air, which is air in an air-conditioned area, such as a room, is sucked into the unit. The casing 11 further has, in a lower part of its front surface, an air outlet 11*b* through which conditioned air is blown out of the unit. The air inlet 11*a* is configured to suck the indoor air. The air outlet 11*b* is configured to supply conditioned air to the air-conditioned area.

The indoor unit 10 further includes a left vertical air-directing vane 12, disposed on the left of the indoor unit 10 as viewed from the front side of the indoor unit 10, for adjusting a vertical air flow direction and a right vertical air-directing vane 13, disposed on the right of the indoor unit 10 as viewed from the front side of the indoor unit 10, for adjusting a vertical air flow direction. In other words, the left vertical air-directing vane 12 and the right vertical air-directing vane 13 are configured to adjust the orientation of the conditioned air, blown from the air outlet 11*b* to the air-conditioned area, in the vertical direction. The left vertical air-directing vane 12 and the right vertical air-directing vane 13 are arranged in the air outlet 11*b*. The left vertical air-directing vane 12 and the right vertical air-directing vane 13 are configured to close the air outlet 11*b* when the indoor unit 10 is off.

As illustrated in FIG. 2, the indoor unit 10 further includes a left lateral air-directing vane 14, disposed in a left part of the air outlet 11*b* as viewed from the front side of the indoor unit 10, for adjusting a lateral air flow direction and a right lateral air-directing vane 15, disposed in a right part of the air outlet 11*b* as viewed from the front side of the indoor unit 10, for adjusting a lateral air flow direction. In other words, the left lateral air-directing vane 14 and the right lateral air-directing vane 15 are arranged behind the left vertical air-directing vane 12 and the right vertical air-directing vane 13. The left lateral air-directing vane 14 and the right lateral air-directing vane 15 are configured to adjust the orientation of the conditioned air, blown from the air outlet 11*b* to the air-conditioned area, in the lateral direction.

The left vertical air-directing vane 12 and the left lateral air-directing vane 14 produce a left partial air flow blown from the air outlet 11*b*. The right vertical air-directing vane 13 and the right lateral air-directing vane 15 produce a right partial air flow blown from the air outlet 11*b*.

FIGS. 1 and 2 illustrating the appearance of the indoor unit 10 differ from each other in the angle at which the indoor unit 10 is viewed. FIG. 2 illustrates the indoor unit 10 viewed from a lower level than that in FIG. 1, such that the entire air outlet 11*b* can be seen. FIG. 1 illustrates the left vertical air-directing vane 12 and the right vertical air-directing vane 13 in closed positions. FIG. 2 illustrates the left vertical air-directing vane 12 and the right vertical air-directing vane 13 in open positions. In FIG. 2, therefore, the left lateral air-directing vane 14 and the right lateral air-directing vane 15 located behind the left vertical air-directing vane 12 and the right vertical air-directing vane 13 can be visually identified.

Figure 3:
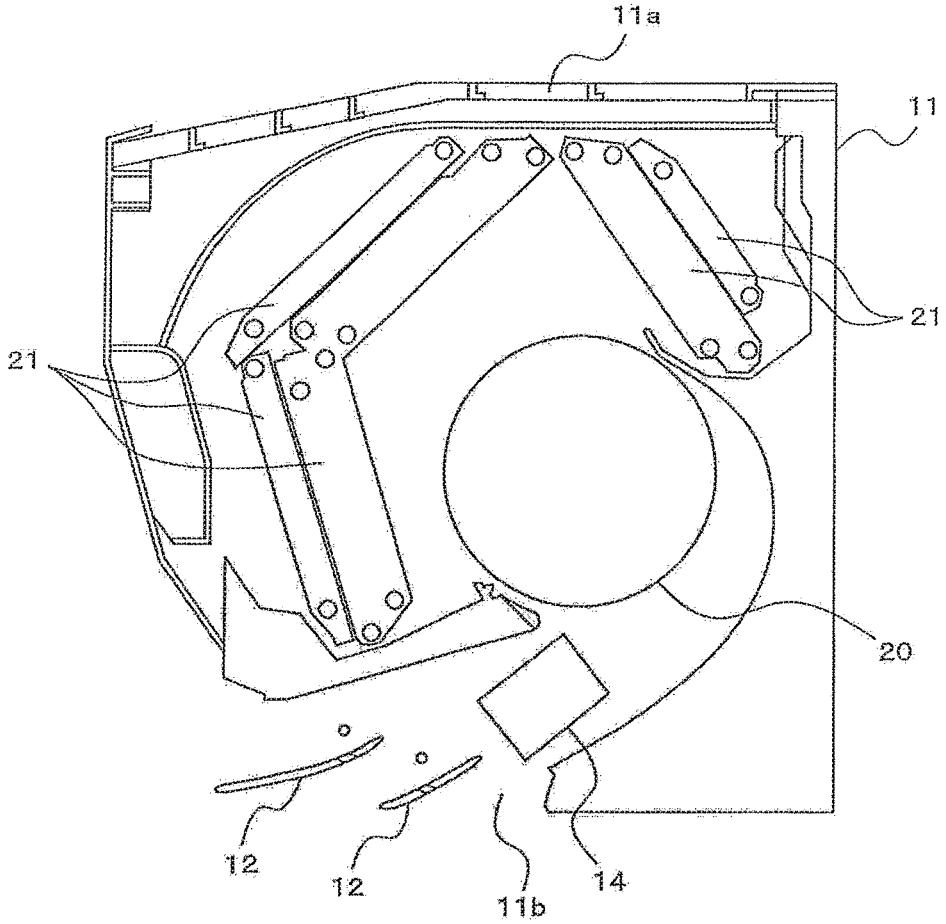
FIG. 3 is a schematic cross-sectional view of the indoor unit taken along the line A-A in FIG. 1.

FIG. 3 is a schematic cross-sectional view of the indoor unit taken along the line A-A in FIG. 1. As illustrated in FIG. 3, the indoor unit 10 further includes a fan 20 that is constituted by, for example, a cross-flow fan, and that is disposed in a central part of the casing 11, and a heat exchanger 21 that is constituted by, for example, a finned-tube heat exchanger, and that is configured to exchange heat between refrigerant and the indoor air to produce conditioned air.

The fan 20 sucks in the indoor air from the air inlet 11*a* and causes the conditioned air to be blown from the air outlet 11*b*. The fan 20 and the heat exchanger 21 are located downstream of the air inlet 11*a* in an air flow direction in the casing 11 and are located upstream of the air outlet 11*b*. Rotation of the fan 20 causes the indoor air to be sucked into the casing 11 through the air inlet 11*a*, undergo heat exchange in the heat exchanger 21, and be blown as conditioned air to the air-conditioned area through the air outlet 11*b*.

Figure 4:
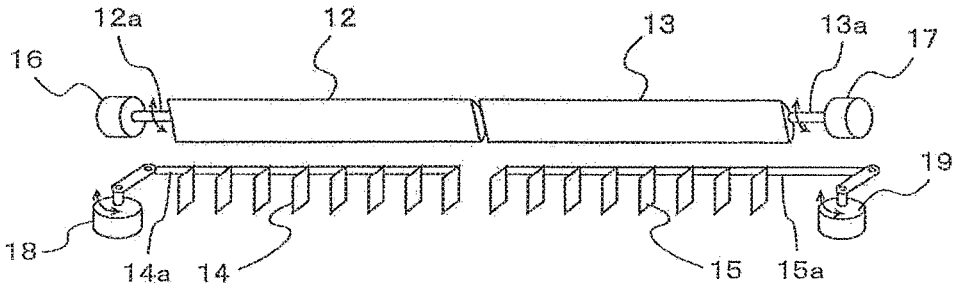
FIG. 4 is a schematic view illustrating exemplary configurations of air-directing vanes included in the indoor unit in FIG. 1 and exemplary configurations of driving motors driving the vanes.

FIG. 4 is a schematic diagram illustrating exemplary configurations of the air-directing vanes included in the indoor unit in FIG. 1 and driving motors for driving the air-directing vanes. As illustrated in FIG. 4, the left vertical air-directing vane 12 and the right vertical air-directing vane 13 constitute a pair of laterally separated vertical air-directing vanes each configured to adjust the orientation of an air flow blown from the air outlet 11*b* in the vertical direction. The left lateral air-directing vane 14 and the right lateral air-directing vane 15 constitute a pair of laterally separated lateral air-directing vanes each configured to adjust the orientation of the air flow blown from the air outlet 11*b* in the lateral direction. The indoor unit 10 can therefore divide the air flow blown from the air outlet 11*b* into two independent partial air flows.

More specifically, the indoor unit 10 includes, in the casing 11, a left vertical driving motor 16, a right vertical driving motor 17, a left lateral driving motor 18, and a right lateral driving motor 19, each of which is constituted by, for example, a stepping motor.

The left vertical air-directing vane 12 is coupled to the left vertical driving motor 16 by a first link rod 12*a*. Specifically, the left vertical air-directing vane 12 is configured such that its angle varies in response to rotational driving of the left vertical driving motor 16. The left vertical air-directing vane 12 can accordingly adjust the orientation of the partial air flow blown from the left part of the air outlet 11*b* in the vertical direction.

The right vertical air-directing vane 13 is coupled to the right vertical driving motor 17 by a second link rod 13*a*. Specifically, the right vertical air-directing vane 13 is configured such that its angle varies in response to rotational driving of the right vertical driving motor 17. The right vertical air-directing vane 13 can accordingly adjust the orientation of the partial air flow blown from the right part of the air outlet 11*b* in the vertical direction.

The left lateral air-directing vane 14 includes a plurality of blades, which are coupled by a third link rod 14*a*. The third link rod 14*a* is coupled at its left end to the left lateral driving motor 18. Consequently, all of the blades constituting the left lateral air-directing vane 14 operate in the same manner in response to rotational driving of the left lateral driving motor 18. Specifically, the left lateral air-directing vane 14 is configured such that the angle of each blade varies in response to the rotational driving of the left lateral driving motor 18. The left lateral air-directing vane 14 can accordingly adjust the orientation of the partial air flow blown from the left part of the air outlet 11*b* in the lateral direction.

The right lateral air-directing vane 15 includes a plurality of blades, which are coupled by a fourth link rod 15*a*. The fourth link rod 15*a* is coupled at its right end to the right lateral driving motor 19. Consequently, all of the blades constituting the right lateral air-directing vane 15 operate in the same manner in response to rotational driving of the right lateral driving motor 19. Specifically, the right lateral air-directing vane 15 is configured such that the angle of each blade varies in response to the rotational driving of the right lateral driving motor 19. The right lateral air-directing vane 15 can accordingly adjust the orientation of the partial air flow blown from the right part of the air outlet 11*b* in the lateral direction.

With the above-described configuration, each of the laterally separated components, such as the left vertical air-directing vane 12, the right vertical air-directing vane 13, the left lateral air-directing vane 14, and the right lateral air-directing vane 15, operates independently in response to the rotational driving of the corresponding one of the left vertical driving motor 16, the right vertical driving motor 17, the left lateral driving motor 18, and the right lateral driving motor 19. In other words, the conditioned air is blown as independent left and right partial air flows from the air outlet 11*b* in the indoor unit 10.

Figure 5:
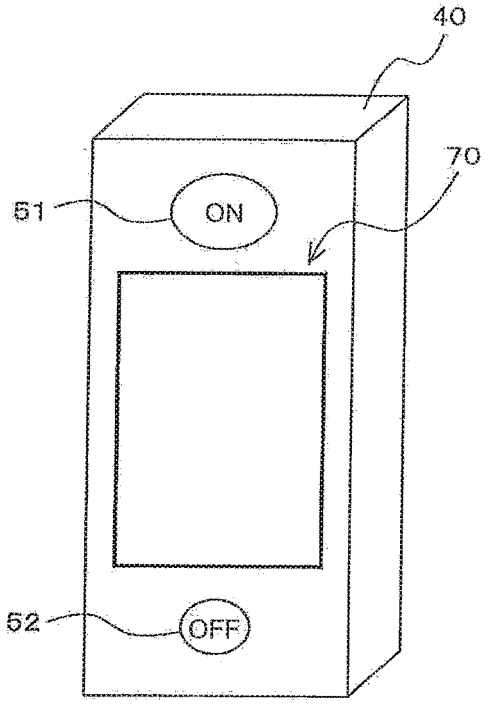
FIG. 5 is a perspective view illustrating an appearance of the remote control device included in the air-conditioning apparatus in FIG. 1.

FIG. 5 is a perspective view illustrating an appearance of the remote control device 40 included in the air-conditioning apparatus 100. As illustrated in FIG. 5, the remote control device 40 includes an ON button 51, an OFF button 52, and an operation unit 70, which constitute an input device. The ON button 51 receives an instruction to start the operation of the air-conditioning apparatus 100. The OFF button 52 receives an instruction to stop the operation of the air-conditioning apparatus 100. The operation unit 70 includes, for example, a touch panel and a liquid crystal display. An input operation can be performed by, for example, touching a display screen.

Figure 6:
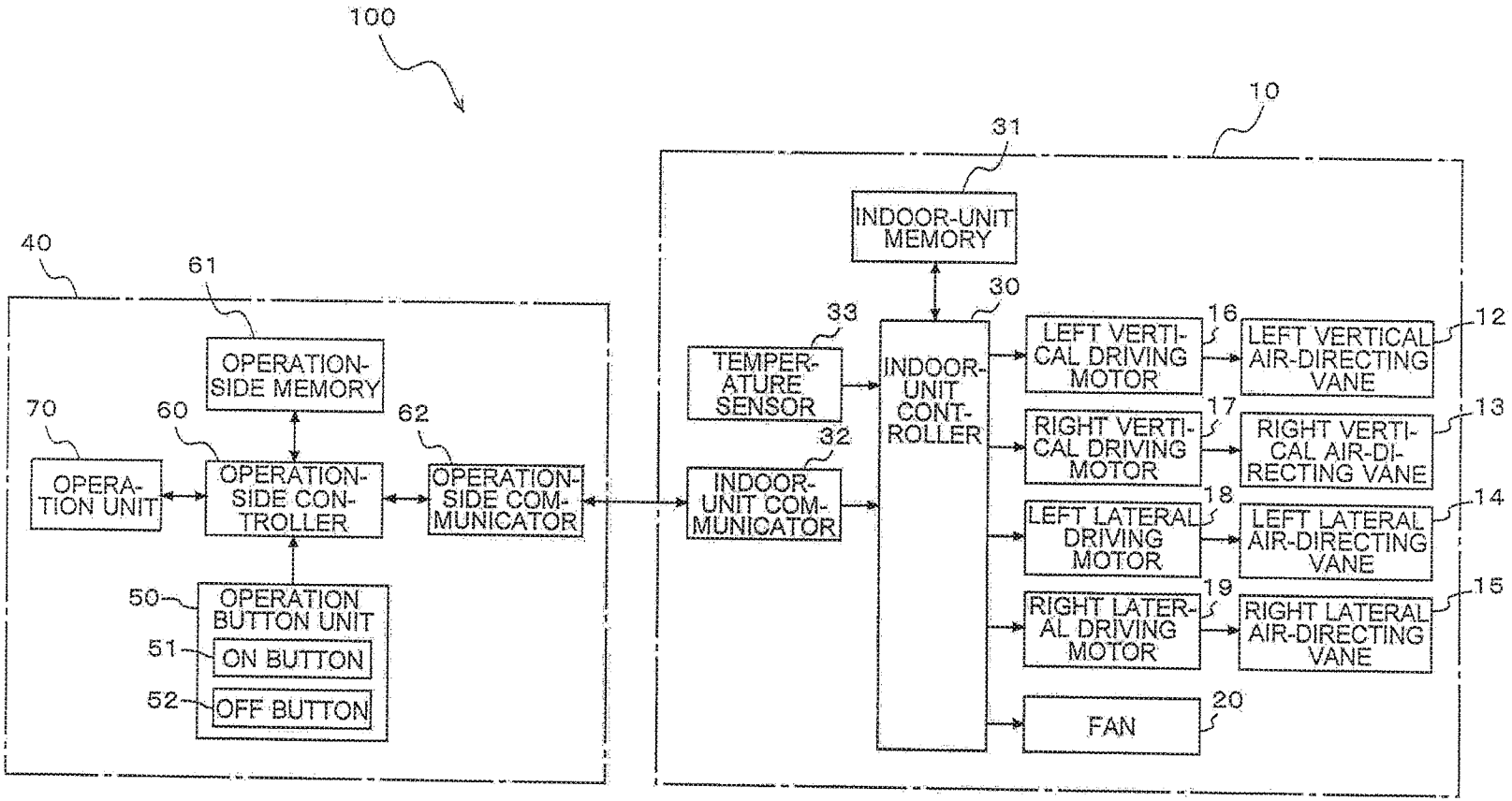
FIG. 6 is a block diagram illustrating a schematic configuration of the air-conditioning apparatus of FIG. 1.

FIG. 6 is a block diagram illustrating a schematic configuration of the air-conditioning apparatus 100. As illustrated in FIG. 6, the remote control device 40 includes an operation button unit 50, an operation-side controller 60, an operation-side memory 61, an operation-side communicator 62, and the operation unit 70.

The operation button unit 50 includes the ON button 51 and the OFF button 52 described above. When the user presses the ON button 51, the operation button unit 50 transmits an operation signal indicating the start of the operation of the air-conditioning apparatus 100 to the operation-side controller 60. Furthermore, when the user presses the OFF button 52, the operation button unit 50 transmits a stop signal indicating the stop of the operation of the air-conditioning apparatus 100 to the operation-side controller 60.

The operation-side memory 61 stores display information, which is information about various setting screens to be displayed on the operation unit 70 and includes letters and graphics. The display information includes data items associated with virtual buttons for the various setting screens.

The operation-side controller 60 accesses the operation-side memory 61 in response to the operation signal transmitted from the operation button unit 50, reads display information to be displayed on the operation unit 70 from the operation-side memory 61, outputs the read display information to the operation unit 70, and causes the operation unit 70 to display the information.

The operation unit 70 displays the display information output from the operation-side controller 60, receives an operation for various settings from the user, and transmits an operation signal indicating details of the operation to the operation-side controller 60. Furthermore, when the operation unit 70 receives a user's operation indicating the completion of the various settings, the operation unit 70 transmits setting information indicating details of the settings made by the user to the operation-side controller 60.

Specifically, each time the operation unit 70 transmits an operation signal, the operation-side controller 60 reads display information associated with the operation signal from the operation-side memory 61, and causes the operation unit 70 to display the read display information. In addition, the operation-side controller 60 transmits, in response to receiving setting information from the operation unit 70, the setting information toward an indoor-unit controller 30. In other words, the operation-side controller 60 is configured to transmit setting information received from the operation unit 70 to the operation-side communicator 62.

In this case, the setting information includes lateral air flow direction information, which is used as a basis of operation adjustment of the left lateral air-directing vane 14 and the right lateral air-directing vane 15. The lateral air flow direction information is set by the user on a lateral air flow direction setting screen, which will be described later, displayed on the operation unit 70.

The operation-side communicator 62 performs data communication with an indoor-unit communicator 32. More specifically, the operation-side communicator 62 sends, for example, setting information to be transmitted from the operation-side controller 60 toward the indoor-unit controller 30, to the indoor-unit communicator 32. Furthermore, the operation-side communicator 62 transmits, for example, a synchronizing signal transmitted from the indoor-unit controller 30 through the indoor-unit communicator 32, to the operation-side controller 60.

The indoor unit 10 uses a refrigeration cycle, through which the refrigerant is circulated, to supply conditioned air to an air-conditioned area, such as a room. The indoor unit 10 includes the fan 20, the indoor-unit controller 30, an indoor-unit memory 31, the indoor-unit communicator 32, and a temperature sensor 33.

The indoor-unit memory 31 stores air-directing control data that includes, for example, table information, in which combinations of air flow directions that are selectable in the remote control device 40 are associated with operations of the left lateral air-directing vane 14 and the right lateral air-directing vane 15.

The indoor-unit communicator 32 performs data communication with the operation-side communicator 62. More specifically, the indoor-unit communicator 32 sends, for example, a synchronizing signal that is to be transmitted from the indoor-unit controller 30 toward the operation-side controller 60, to the operation-side communicator 62. Furthermore, the indoor-unit communicator 32 transmits, for example, setting information transmitted from the operation-side controller 60 through the operation-side communicator 62, to the indoor-unit controller 30.

The indoor-unit controller 30 drives the left vertical driving motor 16, the right vertical driving motor 17, the left lateral driving motor 18, and the right lateral driving motor 19 in accordance with setting information transmitted from the operation-side controller 60. In particular, the indoor-unit controller 30 checks lateral air flow direction information included in the setting information against the air-directing control data stored in the indoor-unit memory 31 to determine the orientation of the left lateral air-directing vane 14 and the orientation of the right lateral air-directing vane 15. The indoor-unit controller 30 drives the left lateral driving motor 18 and the right lateral driving motor 19 such that the left lateral air-directing vane 14 and the right lateral air-directing vane 15 are oriented as determined.

The temperature sensor 33 measures the temperature of an air-conditioned area and outputs temperature data indicating a measurement result to the indoor-unit controller 30. Specifically, the indoor-unit controller 30 has a function of adjusting, for example, a rotation speed of the fan 20, in accordance with the input temperature data.

The indoor-unit controller 30 and the operation-side controller 60 can be implemented by hardware, such as a circuit device that implements the functions of these units, or can be implemented by software running on a microcomputer, such as a DSP, or an arithmetic and logic unit, such as a CPU. In addition, each of the indoor-unit memory 31 and the operation-side memory 61 can be constituted by, for example, a hard disk drive (HDD) or a flash memory.

Figure 7:
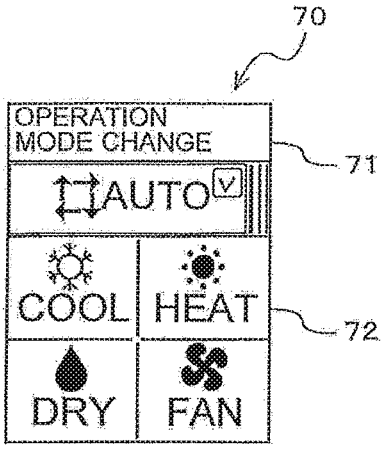
FIG. 7 is an explanatory diagram illustrating an exemplary operation mode setting screen displayed on an operation unit in FIG. 5.
Figure 8:
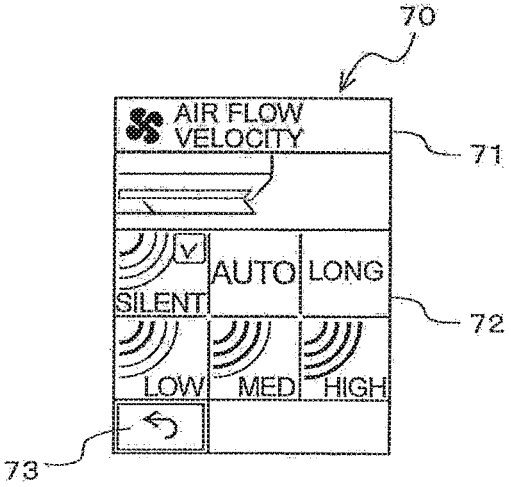
FIG. 8 is an explanatory diagram illustrating an exemplary air flow velocity setting screen displayed on the operation unit in FIG. 5.
Figure 9:
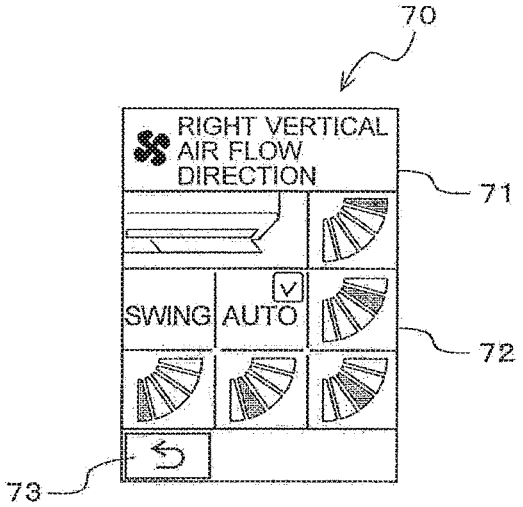
FIG. 9 is an explanatory diagram illustrating an exemplary vertical air flow direction setting screen displayed on the operation unit in FIG. 5.
Figure 10:
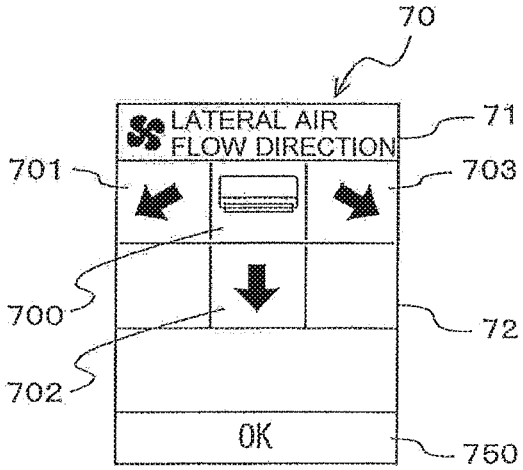
FIG. 10 is an explanatory diagram illustrating an exemplary lateral air flow direction setting screen displayed on the operation unit in FIG. 5.

FIG. 7 is an explanatory diagram illustrating an exemplary operation mode setting screen displayed on the operation unit 70. FIG. 8 is an explanatory diagram illustrating an exemplary air flow velocity setting screen displayed on the operation unit 70. FIG. 9 is an explanatory diagram illustrating an exemplary vertical air flow direction setting screen displayed on the operation unit 70. FIG. 10 is an explanatory diagram illustrating an exemplary lateral air flow direction setting screen displayed on the operation unit 70. The setting screens displayed on the operation unit 70 and operations for switching between the setting screens will be described below with reference to FIGS. 7 to 10. The operation unit 70 switches between the display screens in response to a user's touch as illustrated in FIGS. 7 to 10, for example.

In the operation mode setting screen illustrated in FIG. 7, an item display section 71, which displays an item to be set, displays letters "OPERATION MODE CHANGE". In addition, a selection setting section 72, which displays, for example, choices indicating details of setting, and receives a touch, displays five virtual buttons with letters "AUTO", "COOL", "HEAT", "DRY", and "FAN". Hereinafter, the five virtual buttons with the letters "AUTO", "COOL", "HEAT", "DRY", and "FAN" will be referred to as an AUTO button, a COOL button, a HEAT button, a DRY button, and a FAN button, respectively. FIG. 7 illustrates a case where the user has touched the AUTO button. A check mark is displayed on the AUTO button.

When the user touches the AUTO button, the remote control device 40 receives setting of an automatic operation mode in which a cooling mode or a heating mode is selected on the basis of, for example, a temperature measured by the temperature sensor 33 and the selected mode is implemented. In the automatic operation mode, any one of the cooling mode, the heating mode, a dehumidifying mode, and an air-sending mode may be selected and implemented. Furthermore, when the user touches the COOL button, the HEAT button, the DRY button, or the FAN button, the remote control device 40 receives setting of the cooling mode, the heating mode, the dehumidifying mode, or the air-sending mode.

As described above, when the user touches any of the virtual buttons on the operation mode setting screen, the screen displayed on the operation unit 70 changes to a home screen (not illustrated) for receiving changing to, for example, the operation mode setting screen or a menu screen (not illustrated) that displays a list of air flow settings. The menu screen is a screen displaying a list of various settings, such as air flow velocity setting and air flow direction setting. In the menu screen, the operation unit 70 receives changing to an air flow velocity setting screen or any of air flow direction setting screens. The screen displayed on the operation unit 70 may change from the operation mode setting screen to the air flow velocity setting screen, as illustrated in FIG. 8, in response to a user's touch on any of the virtual buttons.

In the air flow velocity setting screen illustrated in FIG. 8, the item display section 71 displays letters "AIR FLOW VELOCITY" and the selection setting section 72 displays six virtual buttons with letters "SILENT", "AUTO", "LONG", "LOW", "MED", and "HIGH". Hereinafter, the six virtual buttons with the letters "SILENT", "AUTO", "LONG", "LOW", "MED", and "HIGH" will be referred to as a SILENT button, an AUTO button, a LONG button, a LOW button, a MED button, and a HIGH button, respectively. FIG. 8 illustrates a case where the user has touched the SILENT button. A check mark is displayed on the SILENT button.

When the user touches the AUTO button, the remote control device 40 receives setting of an automatic air flow velocity mode in which the air flow velocity is determined on the basis of, for example, a temperature measured by the temperature sensor 33. When the user touches the SILENT button, the LOW button, the MED button, or the HIGH button, the remote control device 40 receives setting of a silent or low-noise air flow, a low-velocity air flow, a medium-velocity air flow between the low-velocity air flow and a high-velocity air flow, or the high-velocity air flow. When the user touches the LONG button, the remote control device 40 receives setting of a long distance mode that provides long-distance air flow distribution for a large living room, for example.

As described above, when the user touches any of the virtual buttons on the air flow velocity setting screen, the screen displayed on the operation unit 70 changes to the menu screen. The screen displayed on the operation unit 70 may change from the air flow velocity setting screen to a vertical air flow direction setting screen, as illustrated in FIG. 9, in response to a user's touch on any of the virtual buttons.

In addition, the selection setting section 72 displays a return button 73. When the user touches the return button 73, the screen returns to a previously displayed setting screen, for example, the operation mode setting screen. In other words, the operation unit 70 can receive change of details of setting on the returned setting screen.

In the vertical air flow direction setting screen for the right partial air flow illustrated in FIG. 9, the item display section 71 displays letters "RIGHT VERTICAL AIR FLOW DIRECTION" and the selection setting section 72 displays a virtual button with letters "SWING", a virtual button with letters "AUTO", five virtual buttons representing angles of the right vertical air-directing vane 13 in the vertical direction, and the return button 53. Hereinafter, the two virtual buttons with the letters "SWING" and "AUTO" will be referred to as a SWING button and an AUTO button. FIG. 9 illustrates a case where the user has touched the AUTO button. A check mark is displayed on the AUTO button.

When the user touches the SWING button, the remote control device 40 receives setting of a swing operation for causing the vertical air-directing vane to reciprocate within a drivable range. When the user touches the AUTO button, the remote control device 40 receives setting of an automatic air flow direction mode in which the air flow direction is determined on the basis of, for example, a temperature measured by the temperature sensor 33. When the user touches any one of the five virtual buttons representing the angles of the right vertical air-directing vane 13 in the vertical direction, the remote control device 40 receives setting of an air flow direction corresponding to the touched virtual button.

For the vertical air flow velocity setting screen for the left partial air flow, the remote control device 40 performs display processing similar to that described with reference to FIG. 9.

As described above, when the user touches any of the virtual buttons on the vertical air flow direction setting screen, the screen displayed on the operation unit 70 changes to the menu screen. The screen displayed on the operation unit 70 may change from the vertical air flow direction setting screen to a lateral air flow direction setting screen, as illustrated in FIG. 10, in response to a user's touch on any of the virtual buttons.

In the lateral air flow direction setting screen illustrated in FIG. 10, the item display section 71 displays letters "LATERAL AIR FLOW DIRECTION". In addition, the selection setting section 72 displays a graphic 700 representing the appearance of the indoor unit 10, three virtual buttons, or a left button 701, a front button 702, and a right button 703 corresponding to three lateral air flow directions, and an OK button 750 for receiving an operation indicating the completion of various settings.

The left button 701 represents the left oblique front direction, the front button 702 represents the front direction, and the right button 703 represents the right oblique front direction. The term "left oblique front direction" as used herein refers to a direction at a predetermined angle from the left and to the front side. The term "right oblique front direction" as used herein refers to a direction at a predetermined angle from the right and to the front side.

The operation unit 70 receives selection of at least two of the three lateral air flow directions, the at least two of the three lateral air flow directions including double selection of at least two of the same one of the lateral air flow directions.

As illustrated in FIG. 10, the left button 701, the front button 702, and the right button 703 are arranged radially around the graphic 700. Consequently, the user can intuitively set a lateral air flow direction by using the remote control device 40.

In Embodiment 1, the operation unit 70 displays the left button 701 as an arrow pointing in the left oblique front direction, the front button 702 as an arrow pointing in the front direction, and the right button 703 as an arrow pointing in the right oblique front direction. Specifically, the user selects and touches two arrows of the three arrows to select lateral air flow directions, thus setting the air flow direction for the left lateral air-directing vane 14 and the air flow direction for the right lateral air-directing vane 15. Furthermore, the user can touch the same arrow twice to select the same air flow direction twice. The angle of each of the arrows displayed as the left button 701, the front button 702, and the right button 703 corresponds to the angle of each of the left lateral air-directing vane 14 and the right lateral air-directing vane 15. Consequently, the user can readily set the air flow directions more intuitively.

When the user selects two virtual buttons of the three virtual buttons corresponding to the lateral air flow directions, that is, the left button 701, the front button 702, and the right button 703 in such a manner that the user can select two different virtual buttons or the same virtual button twice, the operation unit 70 transmits lateral air flow direction information indicating details of the selection to the operation-side controller 60. The operation-side controller 60 transmits the lateral air flow direction information, received from the operation unit 70, to the indoor-unit controller 30. The indoor-unit controller 30 drives the left lateral driving motor 18 and the right lateral driving motor 19 in accordance with the received lateral air flow direction information. Thus, the left lateral air-directing vane 14 and the right lateral air-directing vane 15 are oriented in the directions corresponding to the virtual buttons selected by the user such that the left and right partial air flows do not collide with each other.

The operation unit 70 may transmit setting information to the indoor-unit controller 30 in response to a user's touch on the OK button 750 after the user selects the virtual buttons. The indoor-unit controller 30 may drive the left vertical driving motor 16, the right vertical driving motor 17, the left lateral driving motor 18, the right lateral driving motor 19, and the fan 20 in accordance with the received setting information.

[Lateral Air Flow Direction Setting]

Figure 11:
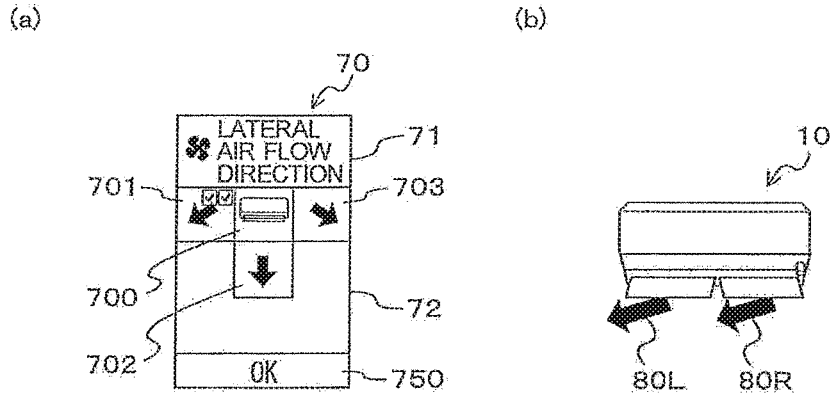
FIG. 11 includes explanatory diagrams illustrating the setting screen of FIG. 10 and an operation of the indoor unit in a case where a left button is selected twice.
Figure 12:
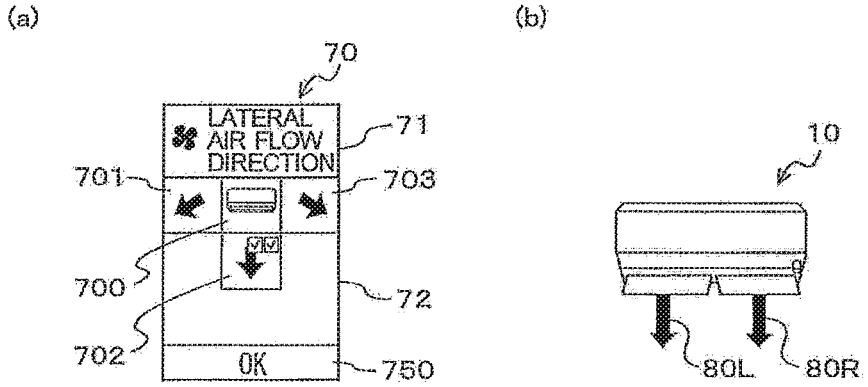
FIG. 12 includes explanatory diagrams illustrating the setting screen of FIG. 10 and an operation of the indoor unit in a case where a front button is selected twice.
Figure 13:
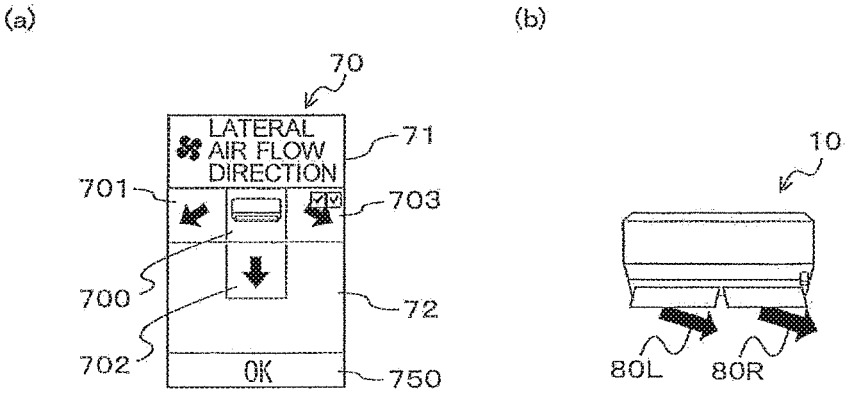
FIG. 13 includes explanatory diagrams illustrating the setting screen of FIG. 10 and an operation of the indoor unit in a case where a right button is selected twice.
Figure 14:
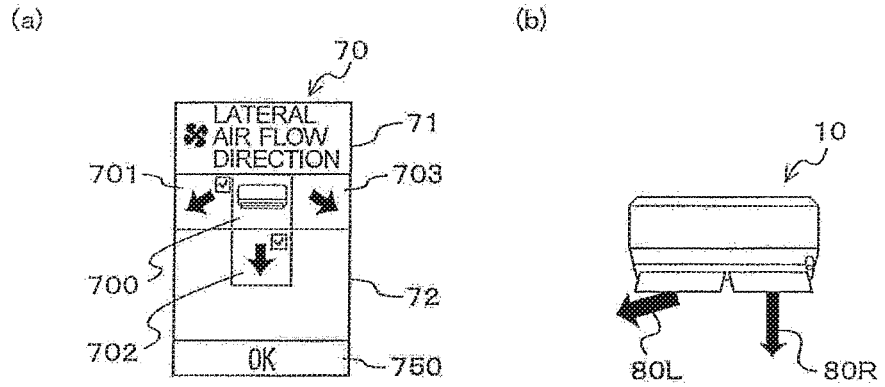
FIG. 14 includes explanatory diagrams illustrating the setting screen of FIG. 10 and an operation of the indoor unit in a case where the left button and the front button are selected.
Figure 15:
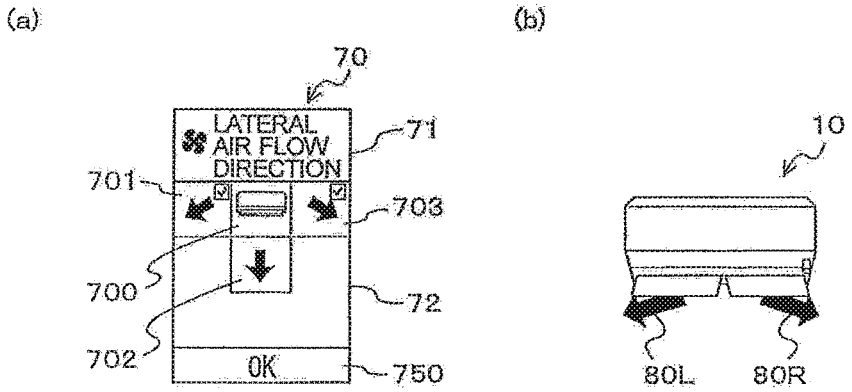
FIG. 15 includes explanatory diagrams illustrating the setting screen of FIG. 10 and an operation of the indoor unit in a case where the left button and the right button are selected.
Figure 16:
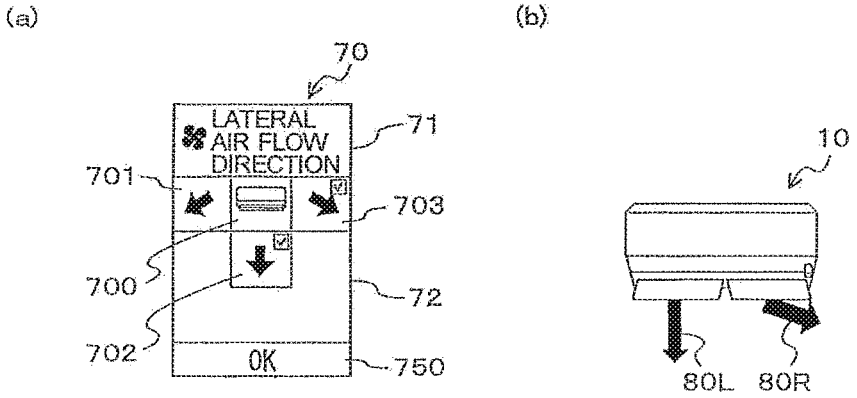
FIG. 16 includes explanatory diagrams illustrating the setting screen of FIG. 10 and an operation of the indoor unit in a case where the front button and the right button are selected.

FIG. 11 includes explanatory diagrams illustrating the setting screen of FIG. 10 and an operation of the indoor unit in a case where the left button is selected twice. FIG. 12 includes explanatory diagrams illustrating the setting screen of FIG. 10 and an operation of the indoor unit in a case where the front button is selected twice. FIG. 13 includes explanatory diagrams illustrating the setting screen of FIG. 10 and an operation of the indoor unit in a case where the right button is selected twice. FIG. 14 includes explanatory diagrams illustrating the setting screen of FIG. 10 and an operation of the indoor unit in a case where the left button and the front button are selected. FIG. 15 includes explanatory diagrams illustrating the setting screen of FIG. 10 and an operation of the indoor unit in a case where the left button and the right button are selected. FIG. 16 includes explanatory diagrams illustrating the setting screen of FIG. 10 and an operation of the indoor unit in a case where the front button and the right button are selected.

Operations for lateral air flow direction settings in the indoor unit 10 and the remote control device 40 will be described in detail with reference to FIGS. 11 to 16. FIGS. 11(*a*) to 16(*a*) are explanatory diagrams each illustrating a state in which two virtual buttons of the three virtual buttons corresponding to the lateral air flow directions are selected, the two virtual buttons of the three virtual buttons including double selection of two of the same one of the virtual buttons. FIGS. 11(*b*) to 16(*b*) are explanatory diagrams each illustrating a schematic drawing of the indoor unit 10, a left air flow arrow 80L representing the orientation of the left lateral air-directing vane 14 and that of the left partial air flow in the lateral direction, and a right air flow arrow 80R representing the orientation of the right lateral air-directing vane 15 and that of the right partial air flow in the lateral direction.

FIG. 11(*a*) illustrates a state in which the left button 701 is selected twice on the lateral air flow direction setting screen displayed on the operation unit 70. Two check marks are displayed on the left button 701. The operation unit 70 receives such setting and transmits lateral air flow direction information indicating that the left button has been selected twice to the indoor-unit controller 30 through the operation-side controller 60.

In this case, the lateral air flow direction information transmitted from the operation unit 70 is information indicating two directions. In other words, the lateral air flow direction information does not contain information indicating the order in which the buttons have been touched by the user and, for example, information associating the two directions with the left lateral air-directing vane 14 and the right lateral air-directing vane 15. The indoor-unit controller 30, therefore, checks the lateral air flow direction information transmitted from the operation unit 70 against the air-directing control data stored in the indoor-unit memory 31, thereby determining an operation of the left lateral air-directing vane 14 and an operation of the right lateral air-directing vane 15, or the orientation of the left lateral air-directing vane 14 and the orientation of the right lateral air-directing vane 15.

Specifically, when the operation unit 70 receives air flow direction setting illustrated in FIG. 11(*a*), the indoor-unit controller 30 drives the left lateral driving motor 18 and the right lateral driving motor 19 with reference to the air-directing control data such that the left lateral air-directing vane 14 and the right lateral air-directing vane 15 are oriented as indicated by the left air flow arrow 80L and the right air flow arrow 80R illustrated in FIG. 11(*b*), respectively. Consequently, the multiple blades constituting the left lateral air-directing vane 14 and the right lateral air-directing vane 15 are oriented in the left oblique front direction.

FIG. 12(*a*) illustrates a state in which the front button 702 is selected twice on the lateral air flow direction setting screen displayed on the operation unit 70. Two check marks are displayed on the front button 702. When the operation unit 70 receives air flow direction setting illustrated in FIG. 12(*a*), the indoor-unit controller 30 drives the left lateral driving motor 18 and the right lateral driving motor 19 with reference to the air-directing control data such that the left lateral air-directing vane 14 and the right lateral air-directing vane 15 are oriented as indicated by the left air flow arrow 80L and the right air flow arrow 80R illustrated in FIG. 12(*b*), respectively. Consequently, the multiple blades constituting the left lateral air-directing vane 14 and the right lateral air-directing vane 15 are oriented in the front direction.

FIG. 13(*a*) illustrates a state in which the right button 703 is selected twice on the lateral air flow direction setting screen displayed on the operation unit 70. Two check marks are displayed on the right button 703. When the operation unit 70 receives air flow direction setting illustrated in FIG. 13(*a*), the indoor-unit controller 30 drives the left lateral driving motor 18 and the right lateral driving motor 19 with reference to the air-directing control data such that the left lateral air-directing vane 14 and the right lateral air-directing vane 15 are oriented as indicated by the left air flow arrow 80L and the right air flow arrow 80R illustrated in FIG. 13(*b*), respectively. Consequently, the multiple blades constituting the left lateral air-directing vane 14 and the right lateral air-directing vane 15 are oriented in the right oblique front direction.

FIG. 14(*a*) illustrates a state in which the left button 701 and the front button 702 are selected on the lateral air flow direction setting screen displayed on the operation unit 70. A check mark is displayed on each of the left button 701 and the front button 702.

When the operation unit 70 receives air flow direction setting illustrated in FIG. 14(*a*), the indoor-unit controller 30 determines, with reference to the air-directing control data, the left oblique front direction for the orientation of the left lateral air-directing vane 14 and the front direction for the orientation of the right lateral air-directing vane 15 such that the partial air flow blown through the left lateral air-directing vane 14 does not collide with the partial air flow blown through the right lateral air-directing vane 15. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 14(*b*), respectively.

In the following description, the partial air flow blown through the left lateral air-directing vane 14 and the partial air flow blown through the right lateral air-directing vane 15 will also be collectively referred to as left and right partial air flows.

FIG. 15(*a*) illustrates a state in which the left button 701 and the right button 703 are selected on the lateral air flow direction setting screen displayed on the operation unit 70. A check mark is displayed on each of the left button 701 and the right button 703.

When the operation unit 70 receives air flow direction setting illustrated in FIG. 15(*a*), the indoor-unit controller 30 determines, with reference to the air-directing control data, the left oblique front direction for the orientation of the left lateral air-directing vane 14 and the right oblique front direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 15(*b*), respectively.

FIG. 16(*a*) illustrates a state in which the front button 702 and the right button 703 are selected on the lateral air flow direction setting screen displayed on the operation unit 70. A check mark is displayed on each of the front button 702 and the right button 703.

When the operation unit 70 receives air flow direction setting illustrated in FIG. 16(*a*), the indoor-unit controller 30 determines, with reference to the air-directing control data, the front direction for the orientation of the left lateral air-directing vane 14 and the right oblique front direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 16(*b*), respectively.

[Change of Lateral Air Flow Direction Settings]

To change the lateral air flow direction settings in the case where two check marks have already been displayed as illustrated in FIGS. 11(*a*) to 16(*a*), the user has only to touch a virtual button corresponding to a newly intended air flow direction.

Specifically, the operation unit 70 is configured such that when the user touches a virtual button with no check mark or a virtual button with one check mark in the case where the two check marks are displayed, the operation unit 70 displays a check mark on the touched virtual button and removes the check mark from the virtual button touched at the second previous time.

An exemplary process of changing the lateral air flow direction settings will be described below on the assumption that the previous settings correspond to the state of FIG. 12(*a*).

When the operation unit 70 receives selection of the left button 701, or a user's touch on the left button 701 in the state of FIG. 12(*a*), the operation unit 70 displays a check mark on the left button 701 and removes one of the check marks on the front button 702, thus providing the state of FIG. 14(*a*). At this time, the operation unit 70 transmits lateral air flow direction information indicating details of the changed settings to the indoor-unit controller 30. In addition, the operation unit 70 stores information indicating that the front button 702 has been previously selected and the left button 701 has been subsequently selected into, for example, an internal memory.

Then, when the operation unit 70 receives selection of the right button 703 in the state of FIG. 14(*a*), the operation unit 70 displays a check mark on the right button 703 and removes the check mark from the front button 702 selected at the second previous time, thus providing the state of FIG. 15(*a*). At this time, the operation unit 70 transmits lateral air flow direction information indicating details of the changed settings to the indoor-unit controller 30. In addition, the operation unit 70 stores information indicating that the left button 701 has been previously selected and the right button 703 has been subsequently selected into, for example, the internal memory.

Then, when the operation unit 70 receives selection of the right button 703 in the state of FIG. 15(*a*), the operation unit 70 displays a second check mark on the right button 703 and removes the check mark from the left button 701 selected at the second previous time, thus providing the state of FIG. 13(*a*). At this time, the operation unit 70 transmits lateral air flow direction information indicating details of the changed settings to the indoor-unit controller 30.

As described above, the operation unit 70 has a function of recording the order in which multiple virtual buttons corresponding to lateral air flow directions have been selected, and changes display of check marks in response to new selection of virtual buttons.

When the operation unit 70 receives change of the settings, the operation unit 70 transmits lateral air flow direction information indicating details of the changed settings to the indoor-unit controller 30. Specifically, when the operation unit 70 receives the change of the settings, the indoor-unit controller 30 operates the left lateral air-directing vane 14 and the right lateral air-directing vane 15 in accordance with the details of the changed settings. Consequently, the user can change the air flow direction settings while checking movements of the left lateral air-directing vane 14 and the right lateral air-directing vane 15 included in the indoor unit 10, resulting in an increase in user-friendliness.

The operation unit 70 may transmit changed lateral air flow direction information to the indoor-unit controller 30 in response to a user's touch on the OK button 750 rather than in response to receiving change of the settings. In this case, if the user touches a virtual button different from a virtual button corresponding to an intended air flow direction, the user can change the settings without causing unintended operations of the left lateral air-directing vane 14 and the right lateral air-directing vane 15.

For example, in a direct mode in which blown air is sent to a person, lateral air flow directions are not set. If the lateral air flow direction setting screen is called up while, for example, the direct mode is set, the operation unit 70 displays the lateral air flow direction setting screen with no check marks in the state of FIG. 10. The operation unit 70 displays no check marks on the lateral air flow direction setting screen at initial setting time.

When any one of the virtual buttons corresponding to the lateral air flow directions is selected in the lateral air flow direction setting screen with no check marks, the operation unit 70 in Embodiment 1 displays two check marks on the selected virtual button. At this time, the operation unit 70 transmits lateral air flow direction information indicating details of the selected settings to the indoor-unit controller 30. For a process of changing the air flow direction settings in such a state, the operation unit 70 performs the process in a manner similar to that described above.

The operation unit 70 may be configured such that when any one of the virtual buttons is selected, the operation unit 70 displays one check mark on the selected virtual button, and when another is selected, the other virtual button including double selection of the same one of the virtual button, the operation unit 70 may display a second check mark on the selected virtual button and transmits lateral air flow direction information indicating details of the selected settings to the indoor-unit controller 30.

As described above, in the air-conditioning apparatus 100 according to Embodiment 1, the remote control device 40 receives selection of two of the three air flow directions in the lateral direction, the two of the three air flow directions including double selection of two of the same one of the air flow directions. As described with reference to FIGS. 11 to 16, the indoor-unit controller 30 individually adjusts the operations of the left lateral air-directing vane 14 and the right lateral air-directing vane 15 on the basis of the selection of the air flow directions in the remote control device 40 such that the left and right partial air flows do not collide with each other. Consequently, the air-conditioning apparatus 100 can produce various air flow patterns in response to simple setting of the lateral air flow directions from the indoor unit 10 such that the left and right partial air flows do not collide with each other. In addition, no collision between the left and right partial air flows can avoid a circumstance in which the air flows may fail to be delivered in a user-intended direction and can prevent noise from occurring due to a collision between the air flows.

In the related-art air-conditioning apparatus, a user has to press the air flow direction setting button multiple times to set a lateral air flow direction. Inevitably, the ease of use is reduced. Such air flow direction setting is far from being intuitive. In contrast, in the air-conditioning apparatus 100 according to Embodiment 1, the remote control device 40 is configured to receive selection of two of the multiple air flow directions in the lateral direction, the two of the multiple air flow directions including double selection of two of the same one of the multiple air flow directions, and enable simple changing of settings. In other words, the air-conditioning apparatus 100 including the user-friendly operation unit 70 enables smooth setting of lateral air flow directions from the indoor unit 10 and smooth changing of air flow direction settings. Thus, an intended lateral air flow pattern can readily be produced.

Furthermore, the operation unit 70 included in the remote control device 40 does not prompt the user to perform a complicated operation, such as a drag operation, in which the user slides his or her finger on the display screen while touching the display screen with the finger, or a pinch-out operation, in which the user separates his or her two fingers away from each other on the display screen while touching the display screen with the two fingers. In other words, the operation unit 70 can be constituted by a touch panel that needs no complicated operation, such as a drag operation and a pinch-out operation, resulting in a reduction in cost.

Additionally, the operation unit 70 includes the three operation buttons corresponding to the lateral air flow directions such that these buttons are arranged radially around the graphic 700. The operation buttons each have the arrow corresponding to the angle of the left lateral air-directing vane 14 and the right lateral air-directing vane 15. Consequently, the user can intuitively select an air flow pattern from among a plurality of air flow patterns, serving as combinations of lateral air flow directions, by touching arrows corresponding to intended air flow directions, thus causing the indoor unit 10 to produce the intuitively selected air flow pattern.

Embodiment 2

Figure 17:
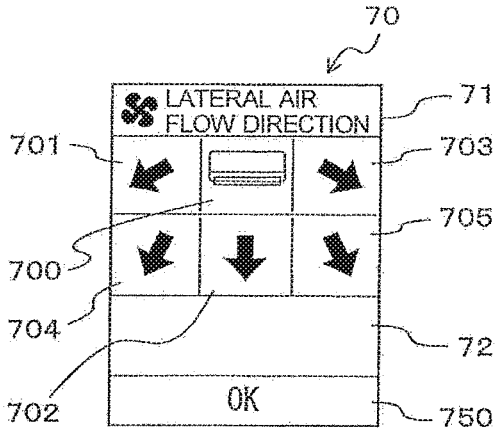
FIG. 17 is an explanatory diagram illustrating a lateral air flow direction setting screen displayed on an operation unit of a remote control device included in an air-conditioning apparatus according to Embodiment 2 of the present invention.

FIG. 17 is an explanatory diagram illustrating a lateral air flow direction setting screen displayed on an operation unit of a remote control device included in an air-conditioning apparatus according to Embodiment 2 of the present invention. An indoor unit and the remote control device included in the air-conditioning apparatus according to Embodiment 2 have substantially the same configurations as those illustrated in FIGS. 1 to 6 for Embodiment 1. The components of the indoor unit and those of the remote control device are designated by the same reference signs and description of the components is omitted. Details of components of the operation unit different from those in Embodiment 1 will be described below with reference to FIG. 17.

As illustrated in FIG. 17, the lateral air flow direction setting screen on the operation unit 70 includes the selection setting section 72 displaying five virtual buttons corresponding to lateral air flow directions, that is, the left button 701, the front button 702, the right button 703, a front left button 704, and a front right button 705.

The front left button 704 indicates the front left direction between the left oblique front direction and the front direction. The front right button 705 indicates the front right direction between the right oblique front direction and the front direction. Specifically, the operation unit 70 receives selection of two of the five air flow directions in the lateral direction, the two of the five air flow directions including double selection of two of the same one of the air flow directions. In this case, the left button 701, the front button 702, the right button 703, the front left button 704, and the front right button 705 are arranged radially around the graphic 700 as illustrated in FIG. 17. The user can intuitively set lateral air flow directions.

In Embodiment 2, the operation unit 70 displays an arrow pointing in the front left direction as the front left button 704 and displays an arrow pointing in the front right direction as the front right button 705. Specifically, the user can set the air flow direction for the left lateral air-directing vane 14 and the air flow direction for the right lateral air-directing vane 15 by touching two of the five arrows. The user can also select the same air flow direction twice by touching the same arrow twice. As the angles of the arrows displayed as the left button 701, the front button 702, the right button 703, the front left button 704, and the front right button 705 correspond to the angles of the left lateral air-directing vane 14 and the right lateral air-directing vane 15, the user can readily set the air flow directions more intuitively.

[Lateral Air Flow Direction Setting]

Figure 18:
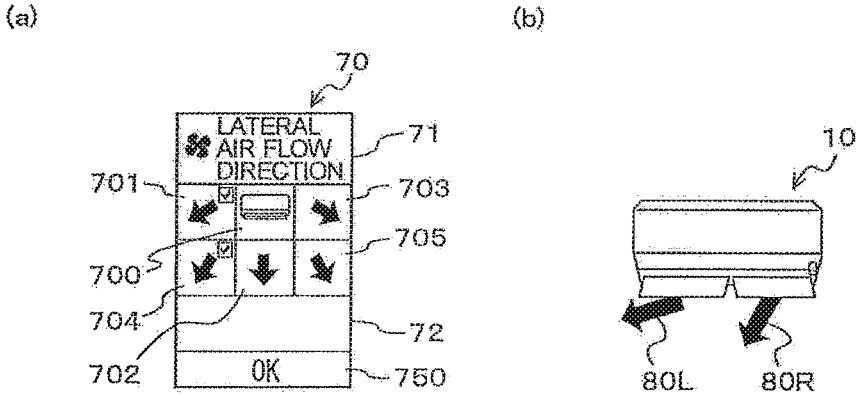
FIG. 18 includes explanatory diagrams illustrating the setting screen of FIG. 17 and an operation of the indoor unit in a case where the left button and a front left button are selected.
Figure 19:
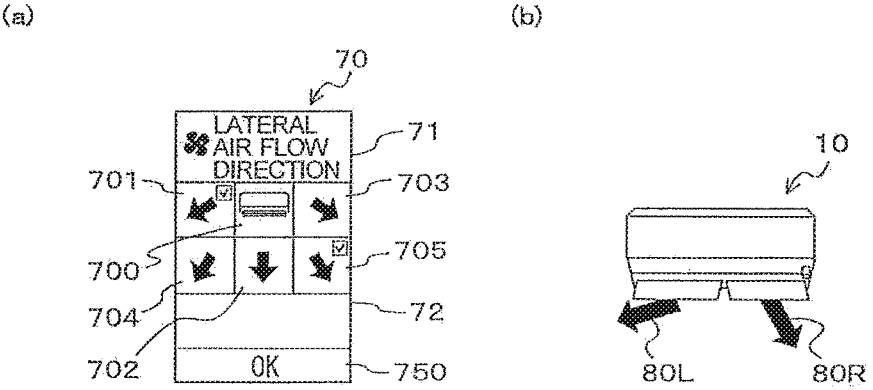
FIG. 19 includes explanatory diagrams illustrating the setting screen of FIG. 17 and an operation of the indoor unit in a case where the left button and a front right button are selected.
Figure 20:
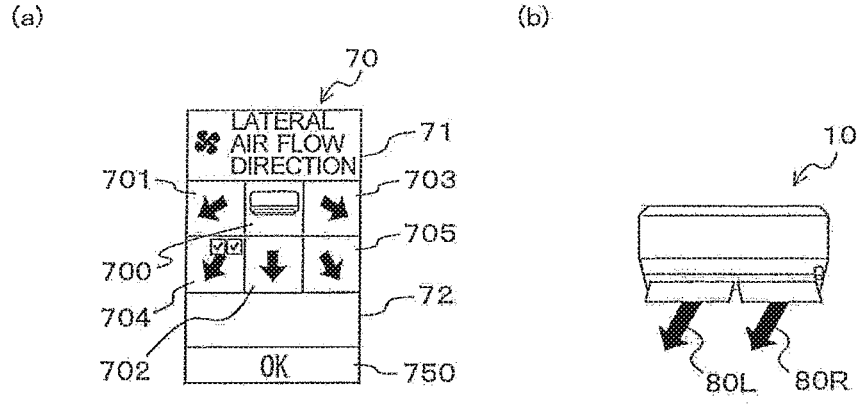
FIG. 20 includes explanatory diagrams illustrating the setting screen of FIG. 17 and an operation of the indoor unit in a case where the front left button is selected twice.
Figure 21:
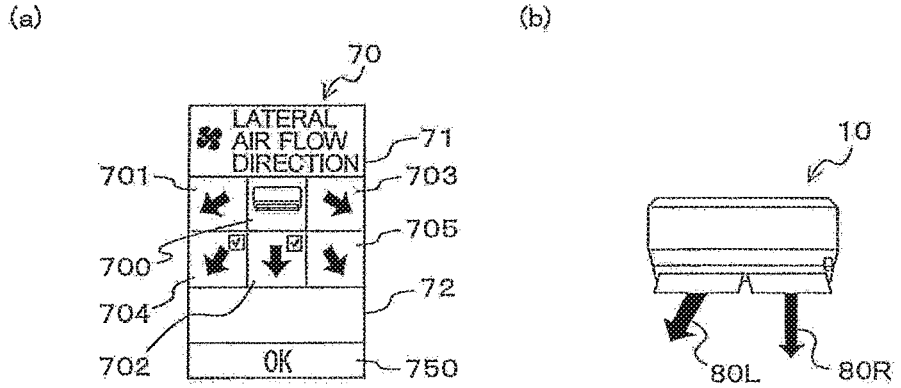
FIG. 21 includes explanatory diagrams illustrating the setting screen of FIG. 17 and an operation of the indoor unit in FIG. 1 in a case where the front left button and the front button are selected.
Figure 22:
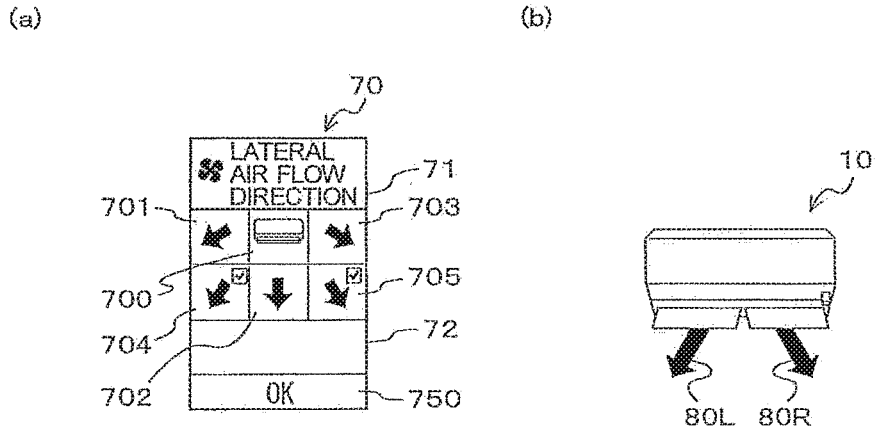
FIG. 22 includes explanatory diagrams illustrating the setting screen of FIG. 17 and an operation of the indoor unit in a case where the front left button and the front right button are selected.
Figure 23:
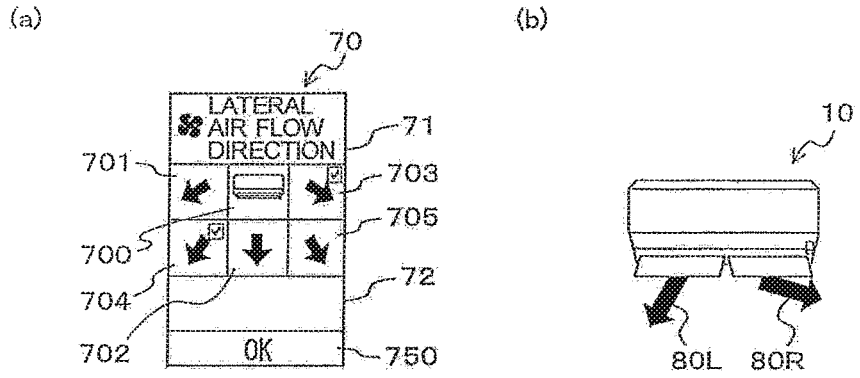
FIG. 23 includes explanatory diagrams illustrating the setting screen of FIG. 17 and an operation of the indoor unit in a case where the front left button and the right button are selected.
Figure 24:
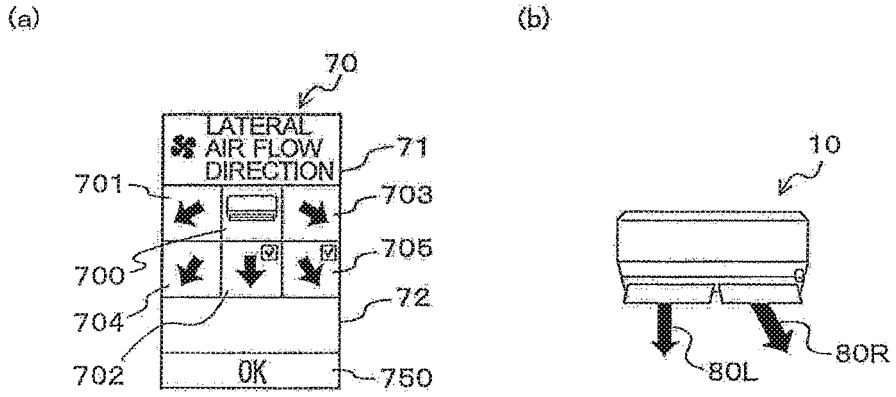
FIG. 24 includes explanatory diagrams illustrating the setting screen of FIG. 17 and an operation of the indoor unit in a case where the front button and the front right button are selected.
Figure 25:
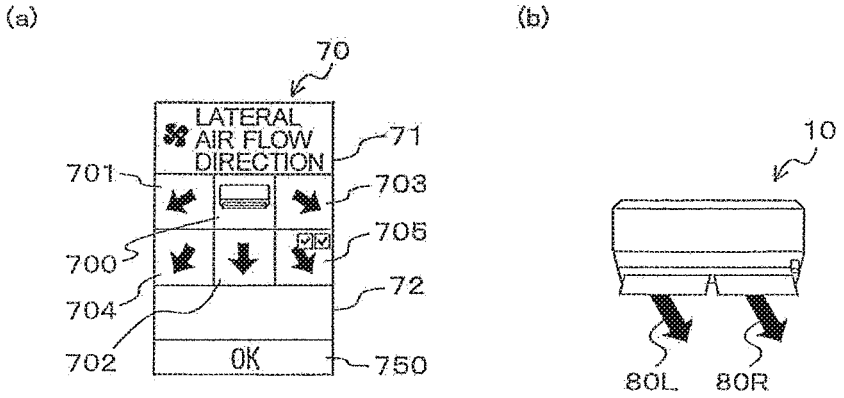
FIG. 25 includes explanatory diagrams illustrating the setting screen of FIG. 17 and an operation of the indoor unit in a case where the front right button is selected twice.
Figure 26:
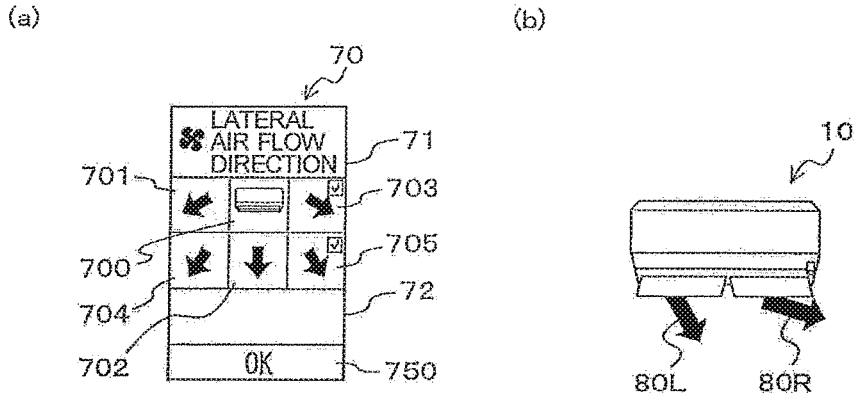
FIG. 26 includes explanatory diagrams illustrating the setting screen of FIG. 17 and an operation of the indoor unit in a case where the right button and the front right button are selected.

FIG. 18 includes explanatory diagrams illustrating the setting screen of FIG. 17 and an operation of the indoor unit in a case where the left button and the front left button are selected. FIG. 19 includes explanatory diagrams illustrating the setting screen of FIG. 17 and an operation of the indoor unit in a case where the left button and the front right button are selected. FIG. 20 includes explanatory diagrams illustrating the setting screen of FIG. 17 and an operation of the indoor unit in a case where the front left button is selected twice. FIG. 21 includes explanatory diagrams illustrating the setting screen of FIG. 17 and an operation of the indoor unit in FIG. 1 in a case where the front left button and the front button are selected. FIG. 22 includes explanatory diagrams illustrating the setting screen of FIG. 17 and an operation of the indoor unit in a case where the front left button and the front right button are selected. FIG. 23 includes explanatory diagrams illustrating the setting screen of FIG. 17 and an operation of the indoor unit in a case where the front left button and the right button are selected. FIG. 24 includes explanatory diagrams illustrating the setting screen of FIG. 17 and an operation of the indoor unit in a case where the front button and the front right button are selected. FIG. 25 includes explanatory diagrams illustrating the setting screen of FIG. 17 and an operation of the indoor unit in a case where the front right button is selected twice. FIG. 26 includes explanatory diagrams illustrating the setting screen of FIG. 17 and an operation of the indoor unit in a case where the right button and the front right button are selected.

Operations for lateral air flow direction settings in the indoor unit 10 and the remote control device 40 will be described below in detail with reference to FIGS. 18 to 26.

FIGS. 18(*a*) to 26(*a*) are explanatory diagrams each illustrating a state in which two virtual buttons of the five virtual buttons corresponding to the lateral air flow directions are selected or one of the five virtual buttons is selected twice. FIGS. 18(*b*) to 26(*b*) are explanatory diagrams each illustrating the schematic drawing of the indoor unit 10, the left air flow arrow 80L, and the right air flow arrow 80R.

FIG. 18(*a*) illustrates a state in which the left button 701 and the front left button 704 are selected on the lateral air flow direction setting screen displayed on the operation unit 70. A check mark is displayed on each of the left button 701 and the front left button 704.

When lateral air flow direction setting is completed in the state illustrated in FIG. 18(*a*), the indoor-unit controller 30 determines, with reference to the air-directing control data, the left oblique front direction for the orientation of the left lateral air-directing vane 14 and the front left direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 18(*b*), respectively.

FIG. 19(*a*) illustrates a state in which the left button 701 and the front right button 705 are selected on the lateral air flow direction setting screen displayed on the operation unit 70. A check mark is displayed on each of the left button 701 and the front right button 705.

When lateral air flow direction setting is completed in the state illustrated in FIG. 19(*a*), the indoor-unit controller 30 determines, with reference to the air-directing control data, the left oblique front direction for the orientation of the left lateral air-directing vane 14 and the front right direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 19(*b*), respectively.

FIG. 20(*a*) illustrates a state in which the front left button 704 is selected twice on the lateral air flow direction setting screen displayed on the operation unit 70. Two check marks are displayed on the front left button 704. When lateral air flow direction setting is completed in the state illustrated in FIG. 20(*a*), the indoor-unit controller 30 drives the left lateral driving motor 18 and the right lateral driving motor 19 with reference to the air-directing control data such that the left lateral air-directing vane 14 and the right lateral air-directing vane 15 are oriented as indicated by the left air flow arrow 80L and the right air flow arrow 80R illustrated in FIG. 20(*b*), respectively. Consequently, the multiple blades constituting the left lateral air-directing vane 14 and the right lateral air-directing vane 15 are oriented in the front left direction.

FIG. 21(*a*) illustrates a state in which the front left button 704 and the front button 702 are selected on the lateral air flow direction setting screen displayed on the operation unit 70. A check mark is displayed on each of the front left button 704 and the front button 702.

When lateral air flow direction setting is completed in the state illustrated in FIG. 21(*a*), the indoor-unit controller 30 determines, with reference to the air-directing control data, the front left direction for the orientation of the left lateral air-directing vane 14 and the front direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 21(*b*), respectively.

FIG. 22(*a*) illustrates a state in which the front left button 704 and the front right button 705 are selected on the lateral air flow direction setting screen displayed on the operation unit 70. A check mark is displayed on each of the front left button 704 and the front right button 705.

When lateral air flow direction setting is completed in the state illustrated in FIG. 22(*a*), the indoor-unit controller 30 determines, with reference to the air-directing control data, the front left direction for the orientation of the left lateral air-directing vane 14 and the front right direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 22(*b*), respectively.

FIG. 23(*a*) illustrates a state in which the front left button 704 and the right button 703 are selected on the lateral air flow direction setting screen displayed on the operation unit 70. A check mark is displayed on each of the front left button 704 and the right button 703.

When lateral air flow direction setting is completed in the state illustrated in FIG. 23(*a*), the indoor-unit controller 30 determines, with reference to the air-directing control data, the front left direction for the orientation of the left lateral air-directing vane 14 and the right oblique front direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 23(*b*), respectively.

FIG. 24(*a*) illustrates a state in which the front button 702 and the front right button 705 are selected on the lateral air flow direction setting screen displayed on the operation unit 70. A check mark is displayed on each of the front button 702 and the front right button 705.

When lateral air flow direction setting is completed in the state illustrated in FIG. 24(*a*), the indoor-unit controller 30 determines, with reference to the air-directing control data, the front direction for the orientation of the left lateral air-directing vane 14 and the front right direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 24(*b*), respectively.

FIG. 25(*a*) illustrates a state in which the front right button 705 is selected twice on the lateral air flow direction setting screen displayed on the operation unit 70. Two check marks are displayed on the front right button 705. When lateral air flow direction setting is completed in the state illustrated in FIG. 25(*a*), the indoor-unit controller 30 drives the left lateral driving motor 18 and the right lateral driving motor 19 with reference to the air-directing control data such that the left lateral air-directing vane 14 and the right lateral air-directing vane 15 are oriented as indicated by the left air flow arrow 80L and the right air flow arrow 80R illustrated in FIG. 25(*b*), respectively. Consequently, the multiple blades constituting the left lateral air-directing vane 14 and the right lateral air-directing vane 15 are oriented in the front right direction.

FIG. 26(*a*) illustrates a state in which the right button 703 and the front right button 705 are selected on the lateral air flow direction setting screen displayed on the operation unit 70. A check mark is displayed on each of the right button 703 and the front right button 705.

When lateral air flow direction setting is completed in the state illustrated in FIG. 26(*a*), the indoor-unit controller 30 determines, with reference to the air-directing control data, the front right direction for the orientation of the left lateral air-directing vane 14 and the right oblique front direction for the orientation of the right lateral air-directing vane 15 such that the left and right partial air flows do not collide with each other. Then, the indoor-unit controller 30 drives the left lateral driving motor 18 and the right lateral driving motor 19 such that the left lateral air-directing vane 14 and the right lateral air-directing vane 15 are oriented as indicated by the left air flow arrow 80L and the right air flow arrow 80R illustrated in FIG. 26(*b*), respectively.

An operation for setting another air flow direction and an operation for changing the air flow direction settings are the same as those in Embodiment 1 described above.

As described above, the remote control device 40 in Embodiment 2 receives selection of two of the five air flow directions in the lateral direction, the two of the five air flow directions including double selection of two of the same one of the air flow directions. As described with reference to FIGS. 18 to 26, the indoor-unit controller 30 individually adjusts the operations of the left lateral air-directing vane 14 and the right lateral air-directing vane 15 on the basis of the selection of the air flow directions in the remote control device 40 such that the left and right partial air flows do not collide with each other. Consequently, the air-conditioning apparatus 100 according to Embodiment 2 can produce more various air flow patterns in response to simple setting of the lateral air flow directions from the indoor unit 10 such that the left and right partial air flows do not collide with each other. In addition, no collision between the left and right partial air flows can avoid a circumstance in which the air flows may fail to be delivered in a user's intended direction and can prevent noise from occurring due to a collision between the air flows.

Additionally, the operation unit 70 includes the five operation buttons corresponding to the lateral air flow directions such that these buttons are arranged radially around the graphic 700. The operation buttons each have the arrow corresponding to the angle of the left lateral air-directing vane 14 and the right lateral air-directing vane 15. Consequently, the user can intuitively select an air flow pattern from among a plurality of air flow patterns, serving as combinations of lateral air flow directions, by touching arrows corresponding to intended air flow directions, thus causing the indoor unit 10 to produce the intuitively selected air flow pattern.

In Embodiment 2, the operation unit 70 is configured to display the five virtual buttons corresponding to the lateral air flow directions. Thus, nine air flow patterns illustrated in FIGS. 18 to 26 can be produced in addition to the six lateral air flow patterns that can be set in Embodiment 1 with no reduction in the ease of use. In other words, the air-conditioning apparatus 100 according to Embodiment 2 can achieve finer adjustment of air flows.

Embodiment 3

Figure 27:
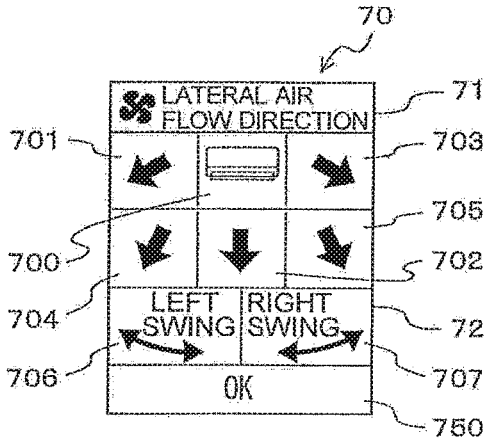
FIG. 27 is an explanatory diagram illustrating a lateral air flow direction setting screen displayed on an operation unit of a remote control device included in an air-conditioning apparatus according to Embodiment 3 of the present invention.

FIG. 27 is an explanatory diagram illustrating a lateral air flow direction setting screen displayed on an operation unit of a remote control device included in an air-conditioning apparatus according to Embodiment 3 of the present invention. An indoor unit and the remote control device included in the air-conditioning apparatus according to Embodiment 3 have substantially the same configurations as those illustrated in FIGS. 1 to 6 for Embodiment 1. The components of the indoor unit and those of the remote control device are designated by the same reference signs and description of the components is omitted. Details of components of the operation unit different from those in Embodiments 1 and 2 will be described below with reference to FIG. 27.

As illustrated in FIG. 27, the lateral air flow direction setting screen on the operation unit 70 includes the selection setting section 72 displaying the left button 701, the front button 702, the right button 703, the front left button 704, the front right button 705, a LEFT SWING button 706, and a RIGHT SWING button 707, which correspond to lateral air flow directions.

The LEFT SWING button 706 indicates a left swing operation that is a swing operation in which main movement is to the left. The RIGHT SWING button 707 indicates a right swing operation that is a swing operation in which main movement is to the right. In other words, the lateral air flow directions include air flow directions varying with swinging.

The operation unit 70 in Embodiment 3 receives selection of two of the seven air flow directions in the lateral direction, the two of the seven air flow directions including double selection of two of the same one of the air flow directions. As illustrated in FIG. 27, the left button 701, the front button 702, the right button 703, the front left button 704, the front right button 705, the LEFT SWING button 706, and the RIGHT SWING button 707 are arranged radially around the graphic 700. Thus, the user can intuitively set lateral air flow directions.

In Embodiment 3, the operation unit 70 displays, as the LEFT SWING button 706, letters "LEFT SWING" and a double-pointed, curved arrow sloping upward to the left, and further displays, as the RIGHT SWING button 707, letters "RIGHT SWING" and a double-pointed, curved arrow sloping upward to the right. The user can touch two of the seven arrows to set air flow directions for the left lateral air-directing vane 14 and the right lateral air-directing vane 15. The user can touch the same arrow twice to select the same air flow direction twice.

In this case, the angles of the arrows displayed as the left button 701, the front button 702, the right button 703, the front left button 704, and the front right button 705 correspond to the angles of the left lateral air-directing vane 14 and the right lateral air-directing vane 15. In addition, the double-pointed arrows displayed on the LEFT SWING button 706 and the RIGHT SWING button 707 can be reminded of swing operations to both directions. Consequently, the user can readily set the lateral air flow directions more intuitively.

[Lateral Air Flow Direction Setting]

Figure 28:
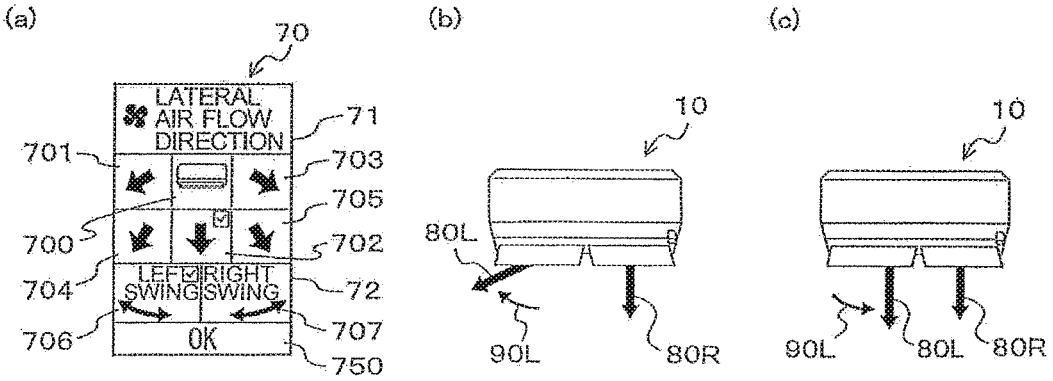
FIG. 28 includes explanatory diagrams illustrating the setting screen of FIG. 27 and an operation of the indoor unit in a case where a LEFT SWING button and one of a plurality of virtual buttons corresponding to lateral air flow directions are selected.
Figure 29:
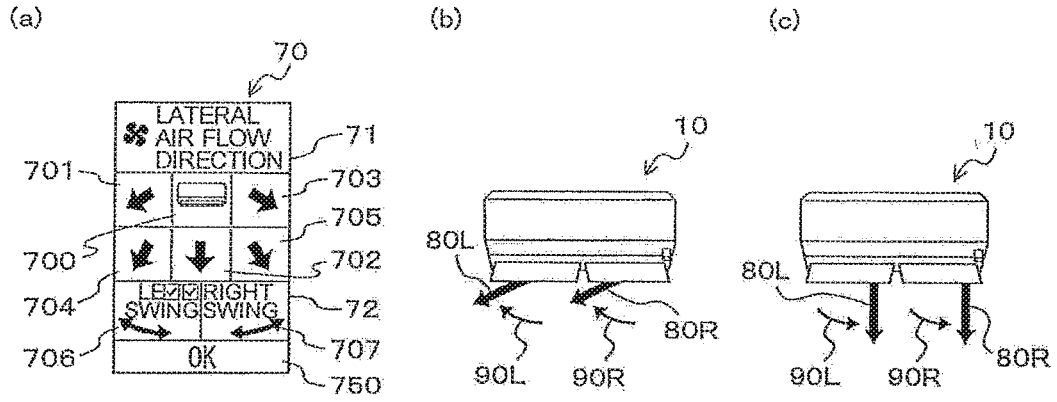
FIG. 29 includes explanatory diagrams illustrating the setting screen of FIG. 27 and an operation of the indoor unit in a case where the LEFT SWING button is selected twice.
Figure 30:
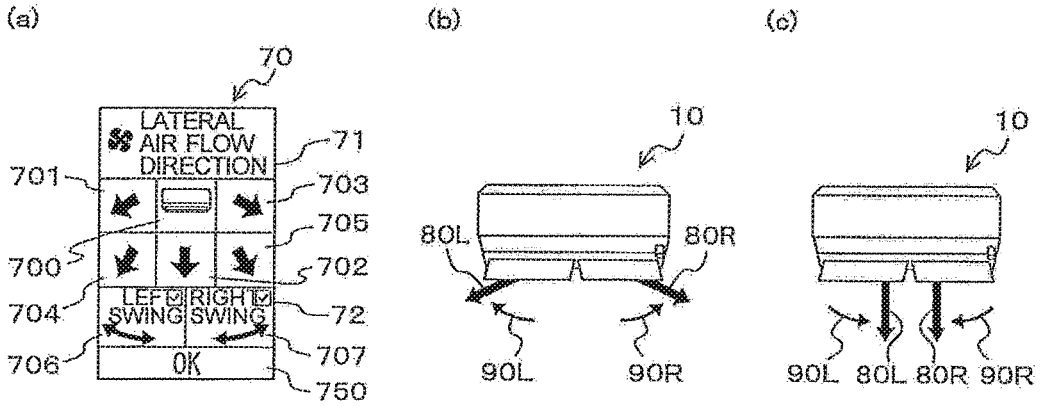
FIG. 30 includes explanatory diagrams illustrating the setting screen of FIG. 27 and a first exemplary operation of the indoor unit in a case where the LEFT SWING button and a RIGHT SWING button are selected.
Figure 31:
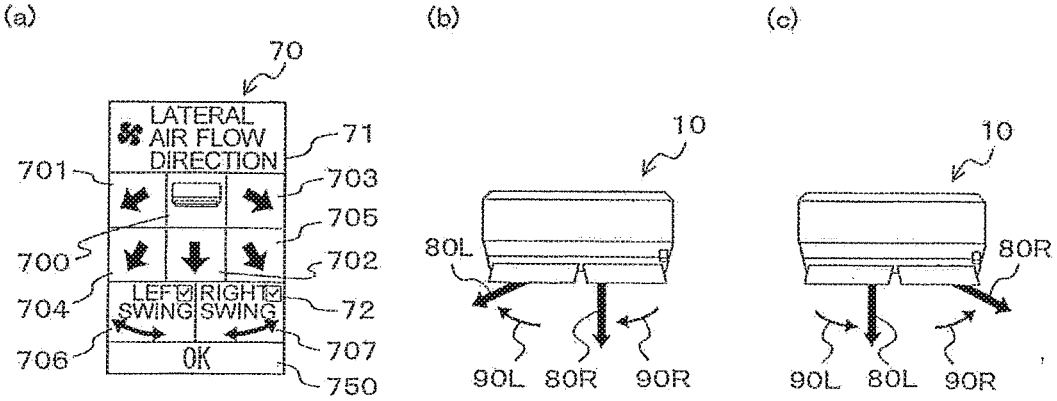
FIG. 31 includes explanatory diagrams illustrating the setting screen of FIG. 27 and a second exemplary operation of the indoor unit in the case where the LEFT SWING button and the RIGHT SWING button are selected.
Figure 32:
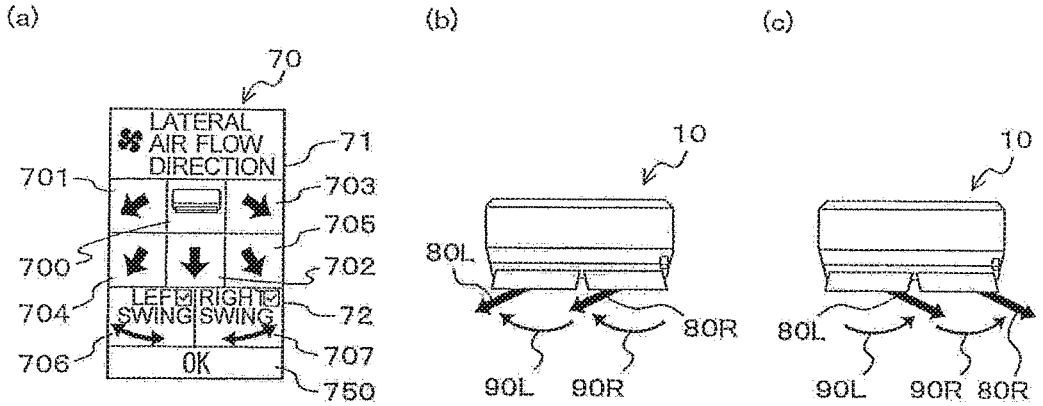
FIG. 32 includes explanatory diagrams illustrating the setting screen of FIG. 27 and a third exemplary operation of the indoor unit in the case where the LEFT SWING button and the RIGHT SWING button are selected.
Figure 33:
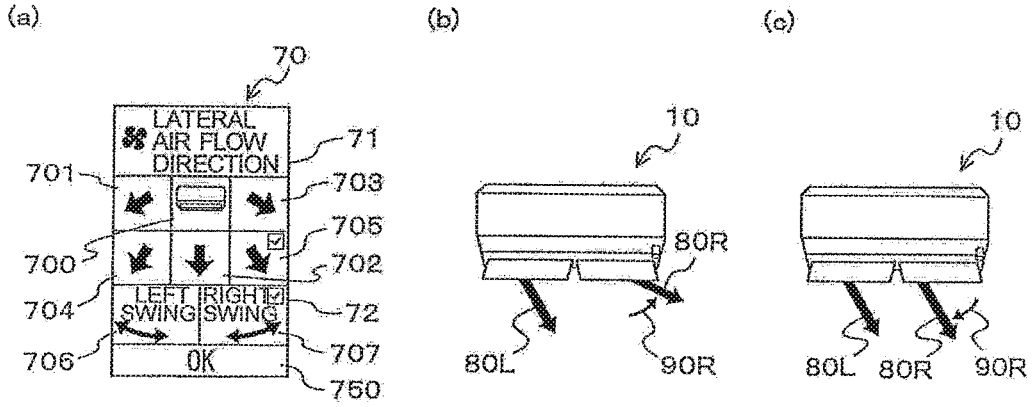
FIG. 33 includes explanatory diagrams illustrating the setting screen of FIG. 27 and an operation of the indoor unit in a case where the RIGHT SWING button and one of the plurality of virtual buttons corresponding to the lateral air flow directions are selected.
Figure 34:
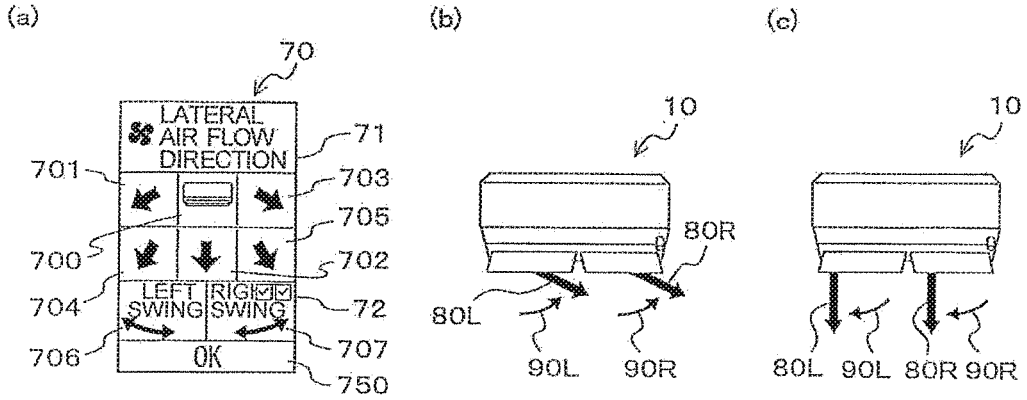
FIG. 34 includes explanatory diagrams illustrating the setting screen of FIG. 27 and an operation of the indoor unit in a case where the RIGHT SWING button is selected twice.

FIG. 28 includes explanatory diagrams illustrating the setting screen of FIG. 27 and an operation of the indoor unit in a case where the LEFT SWING button and one of the multiple virtual buttons corresponding to the lateral air flow directions are selected. FIG. 29 includes explanatory diagrams illustrating the setting screen of FIG. 27 and an operation of the indoor unit in a case where the LEFT SWING button is selected twice. FIG. 30 includes explanatory diagrams illustrating the setting screen of FIG. 27 and a first exemplary operation of the indoor unit in a case where the LEFT SWING button and the RIGHT SWING button are selected. FIG. 31 includes explanatory diagrams illustrating the setting screen of FIG. 27 and a second exemplary operation of the indoor unit in the case where the LEFT SWING button and the RIGHT SWING button are selected. FIG. 32 includes explanatory diagrams illustrating the setting screen of FIG. 27 and a third exemplary operation of the indoor unit in the case where the LEFT SWING button and the RIGHT SWING button are selected. FIG. 33 includes explanatory diagrams illustrating the setting screen of FIG. 27 and an operation of the indoor unit in a case where the RIGHT SWING button and one of the multiple virtual buttons corresponding to the lateral air flow directions are selected. FIG. 34 includes explanatory diagrams illustrating the setting screen of FIG. 27 and an operation of the indoor unit in a case where the RIGHT SWING button is selected twice.

The indoor unit 10 and operations based on lateral air flow direction settings made by using the remote control device 40 will be described below in detail with reference to FIGS. 28 to 34.

FIGS. 28(*a*) to 34(*a*) are explanatory diagrams each illustrating a state in which two virtual buttons of the seven virtual buttons corresponding to the lateral air flow directions are selected or one of the seven virtual buttons is selected twice. FIGS. 28(*b*) to 34(*b*) are explanatory diagrams each illustrating the schematic drawing of the indoor unit 10, the left air flow arrow 80L, the right air flow arrow 80R, and at least one of a swing operation 90L of the left lateral air-directing vane 14 moving forward, or in a forward path and a swing operation 90R of the right lateral air-directing vane 15 moving in the forward path. FIGS. 28(*c*) to 34(*c*) are explanatory diagrams each illustrating the schematic drawing of the indoor unit 10, the left air flow arrow 80L, the right air flow arrow 80R, and at least one of the swing operation 90L of the left lateral air-directing vane 14 moving backward, or in a backward path and the swing operation 90R of the right lateral air-directing vane 15 moving in the backward path.

In FIGS. 28(*b*) to 34(*b*), the swing operation 90L represents that the left lateral air-directing vane 14 swings forward up to a position indicated by the left air flow arrow 80L. In addition, the swing operation 90R represents that the right lateral air-directing vane 15 swings forward up to a position indicated by the right air flow arrow 80R.

In FIGS. 28(*c*) to 34(*c*), the swing operation 90L represents that the left lateral air-directing vane 14 swings backward up to a position indicated by the left air flow arrow 80L. In addition, the swing operation 90R represents that the right lateral air-directing vane 15 swings backward up to a position indicated by the right air flow arrow 80R.

FIG. 28(*a*) illustrates a state in which the LEFT SWING button 706 and the front button 702 are selected on the lateral air flow direction setting screen displayed on the operation unit 70. A check mark is displayed on each of the LEFT SWING button 706 and the front button 702.

When lateral air flow direction setting is completed in the state illustrated in FIG. 28(*a*), the indoor-unit controller 30 determines, with reference to the air-directing control data, the front direction for the orientation of the right lateral air-directing vane 15, and adjusts the swing operation of the left lateral air-directing vane 14 such that the partial air flow blown through the right lateral air-directing vane 15 does not collide with the partial air flow blown through the left lateral air-directing vane 14. Specifically, the indoor-unit controller 30 restricts the swing operation of the left lateral air-directing vane 14 such that the left lateral air-directing vane 14 does not move to the right beyond the front direction.

Although FIG. 28 illustrates a case where the front button 702 is selected as one of the multiple virtual buttons corresponding to the lateral air flow directions, the indoor unit 10 and the remote control device 40 perform operations similar to those described above when the left button 701, the right button 703, the front left button 704, or the front right button 705 is selected. For example, when the right button 703 is selected, the indoor-unit controller 30 adjusts the left lateral air-directing vane 14 such that the left lateral air-directing vane 14 does not move to the right beyond the right oblique front direction. If the right button 703 or the front right button 705 is selected, the indoor-unit controller 30 may adjust the left lateral air-directing vane 14, as indicated by the arrow displayed on the LEFT SWING button 706, such that the left lateral air-directing vane 14 does not move to the right beyond the front direction. If the left button 701 is selected, the swing range of the left lateral air-directing vane 14 will be relatively narrowed.

FIG. 29(*a*) illustrates a state in which the LEFT SWING button 706 is selected twice on the lateral air flow direction setting screen displayed on the operation unit 70. Two check marks are displayed on the LEFT SWING button 706.

When lateral air flow direction setting is completed in the state illustrated in FIG. 29(*a*), the indoor-unit controller 30 performs control with reference to the air-directing control data such that the left lateral air-directing vane 14 and the right lateral air-directing vane 15 swing within a range between the left oblique front direction and the front direction. At this time, to avoid a collision between the left and right partial air flows, the indoor-unit controller 30 performs control such that the left lateral air-directing vane 14 and the right lateral air-directing vane 15 swing in the same direction. More specifically, the indoor-unit controller 30 performs control such that the left lateral air-directing vane 14 and the right lateral air-directing vane 15 swing parallel to each other.

FIGS. 30(*a*) to 32(*a*) illustrate a state in which the LEFT SWING button 706 and the RIGHT SWING button 707 are selected on the lateral air flow direction setting screen displayed on the operation unit 70. A check mark is displayed on each of the LEFT SWING button 706 and the RIGHT SWING button 707.

For the first exemplary operation illustrated in FIGS. 30(*b*) and 30(*c*), when lateral air flow direction setting is completed in this state, the indoor-unit controller 30 performs control with reference to the air-directing control data such that the left lateral air-directing vane 14 and the right lateral air-directing vane 15 swing in opposite directions. At this time, to avoid a collision between the left and right partial air flows, the indoor-unit controller 30 restricts the backward swing, illustrated in FIG. 30(*c*), of the left lateral air-directing vane 14 and the right lateral air-directing vane 15 such that the vanes do not move beyond the front direction.

Furthermore, as in the second exemplary operation illustrated in FIGS. 31(*b*) and 31(*c*), the indoor-unit controller 30 may restrict the movement of the left lateral air-directing vane 14 such that the vane is movable within a range between the left oblique front direction and the front direction, restrict the movement of the right lateral air-directing vane 15 such that the vane is movable within a range between the right oblique front direction and the front direction, and then perform control such that the left lateral air-directing vane 14 and the right lateral air-directing vane 15 swing in the same direction. For the second exemplary operation, the indoor-unit controller 30 performs control such that the right lateral air-directing vane 15 does not move forward beyond the front direction (refer to FIG. 31(*b*)) and the left lateral air-directing vane 14 does not move backward beyond the front direction (refer to FIG. 31(*c*)).

Furthermore, as in the third exemplary operation illustrated in FIGS. 32(*b*) and 32(*c*), the indoor-unit controller 30 may permit the left lateral air-directing vane 14 and the right lateral air-directing vane 15 to fully swing without any restrictions on the movement ranges of the vanes. In other words, the indoor-unit controller 30 may perform control such that the left lateral air-directing vane 14 and the right lateral air-directing vane 15 swing within a range between the left oblique front direction and the right oblique front direction. To avoid a collision between the left and right partial air flows in the third exemplary operation, the indoor-unit controller 30 performs control such that the left lateral air-directing vane 14 and the right lateral air-directing vane 15 swing parallel to each other.

Additionally, the indoor-unit controller 30 may permit one of the left lateral air-directing vane 14 and the right lateral air-directing vane 15 to fully swing and restrict the swing range of the other one of the left lateral air-directing vane 14 and the right lateral air-directing vane 15.

FIG. 33(*a*) illustrates a state in which the RIGHT SWING button 707 and the front right button 705 are selected on the lateral air flow direction setting screen displayed on the operation unit 70. A check mark is displayed on each of the RIGHT SWING button 707 and the front right button 705.

When lateral air flow direction setting is completed in the state illustrated in FIG. 33(*a*), the indoor-unit controller 30 determines, with reference to the air-directing control data, the front right direction for the orientation of the left lateral air-directing vane 14, and adjusts the swing operation of the right lateral air-directing vane 15 such that the partial air flow blown through the left lateral air-directing vane 14 does not collide with the partial air flow blown through the right lateral air-directing vane 15. Specifically, the indoor-unit controller 30 restricts the swing operation of the right lateral air-directing vane 15 such that the right lateral air-directing vane 15 does not move to the left beyond the front right direction.

Although FIG. 33 illustrates a case where the front right button 705 is selected as one of the multiple virtual buttons corresponding to the lateral air flow directions, the indoor unit 10 and the remote control device 40 achieve operations similar to those described above when the left button 701, the front button 702, the right button 703, or the front left button 704 is selected. For example, when the left button 701 is selected, the indoor-unit controller 30 performs control such that the right lateral air-directing vane 15 does not move to the left beyond the left oblique front direction. If the left button 701 or the front left button 704 is selected, the indoor-unit controller 30 may adjust the right lateral air-directing vane 15, as indicated by the arrow displayed on the RIGHT SWING button 707, such that the right lateral air-directing vane 15 does not move to the left beyond the front direction. If the right button 703 is selected, the swing range of the right lateral air-directing vane 15 will be relatively narrowed.

FIG. 34(*a*) illustrates a state in which the RIGHT SWING button 707 is selected twice on the lateral air flow direction setting screen displayed on the operation unit 70. Two check marks are displayed on the RIGHT SWING button 707.

When lateral air flow direction setting is completed in the state illustrated in FIG. 34(*a*), the indoor-unit controller 30 performs control with reference to the air-directing control data such that the left lateral air-directing vane 14 and the right lateral air-directing vane 15 swing within a range between the right oblique front direction and the front direction. At this time, to avoid a collision between the left and right partial air flows, the indoor-unit controller 30 performs control such that the left lateral air-directing vane 14 and the right lateral air-directing vane 15 swing in the same direction. More specifically, the indoor-unit controller 30 performs control such that the left lateral air-directing vane 14 and the right lateral air-directing vane 15 swing parallel to each other.

An operation for setting another air flow direction and an operation for changing the air flow direction settings are the same as those in Embodiments 1 and 2 described above.

As described above, the remote control device 40 in Embodiment 3 receives selection of two of the seven air flow directions in the lateral direction, the two of the seven air flow directions including double selection of two of the same one of the air flow directions. As described with reference to FIGS. 28 to 34, the indoor-unit controller 30 individually adjusts the operations of the left lateral air-directing vane 14 and the right lateral air-directing vane 15 on the basis of the selection of the air flow directions in the remote control device 40 such that the left and right partial air flows do not collide with each other. Consequently, the air-conditioning apparatus 100 according to Embodiment 3 can produce more various air flow patterns in response to simple setting of the lateral air flow directions from the indoor unit 10 such that the left and right partial air flows do not collide with each other. In addition, no collision between the left and right partial air flows can avoid a circumstance in which the air flows may fail to be delivered in a user's intended direction and can prevent noise from occurring due to a collision between the air flows.

Additionally, the operation unit 70 includes the seven operation buttons corresponding to the lateral air flow directions such that these buttons are arranged radially around the graphic 700. The operation buttons each have the arrow corresponding to the angle of the left lateral air-directing vane 14 and the right lateral air-directing vane 15. Consequently, the user can intuitively select an air flow pattern from among a plurality of air flow patterns, serving as combinations of lateral air flow directions, by touching arrows corresponding to intended air flow directions, thus causing the indoor unit 10 to produce the intuitively selected air flow pattern.

In Embodiment 3, the operation unit 70 is configured to display the seven virtual buttons corresponding to the lateral air flow directions. Thus, thirteen air flow patterns illustrated in FIGS. 28 to 34 can be produced in addition to the six lateral air flow patterns that can be set in Embodiment 1 and the nine lateral air flow patterns that can be additionally set in Embodiment 2 with no reduction in the ease of use. In other words, the air-conditioning apparatus 100 according to Embodiment 3 can achieve further finer adjustment of air flows.

In Embodiment 3 illustrated above, the operation unit 70 has the lateral air flow direction setting screen including the two SWING buttons in addition to the five virtual buttons corresponding to the lateral air flow directions illustrated in Embodiment 2. In some embodiments, the lateral air flow direction setting screen of the operation unit 70 includes the two SWING buttons in addition to, for example, the three virtual buttons corresponding to the lateral air flow directions illustrated in Embodiment 1. The air-conditioning apparatus 100 with such a configuration can produce the six lateral air flow patterns, which can be set in Embodiment 1, and the nine air flow patterns, each based on selection of a combination of one of the three virtual buttons corresponding to the lateral air flow directions and one SWING button and selection of the two SWING buttons, with no reduction in the ease of use.

Embodiments 1, 2, and 3 described above are preferred exemplary embodiments of the air-conditioning apparatus. These exemplary embodiments are not intended to limit the technical scope of the present invention. For example, Embodiments 1, 2, and 3 illustrate the three, five, and seven virtual buttons corresponding to the lateral air flow directions displayed on the operation unit 70 respectively. In some embodiments, for example, finer angle setting or dividing each swing operation into smaller phases is made such that the operation unit 70 displays eight or more virtual buttons corresponding to lateral air flow directions. Furthermore, the operation unit 70 may display two virtual buttons for each air flow direction. With such a configuration, the air-conditioning apparatus 100 can achieve air flow direction adjustment similar to that described above if the operation unit 70 has no function of receiving double selection of the same virtual button.

The arrows in the drawings are illustrated as the multiple virtual buttons corresponding to the lateral air flow directions, the left air flow arrow 80L, and the right air flow arrow 80R, and the angles of the arrows have been described in association with the angles of the left lateral air-directing vane 14 and the right lateral air-directing vane 15. In some embodiments, the angle of each of the left lateral air-directing vane 14 and the right lateral air-directing vane 15 moving in response to a user's touch on the left button 701, the right button 703, the front left button 704, or the front right button 705 can be appropriately changed. Additionally, the movement range of the left lateral air-directing vane 14 or the right lateral air-directing vane 15 moving in response to a user's touch on the LEFT SWING button 706 or the RIGHT SWING button 707 can be appropriately increased or reduced.

Embodiments 1, 2, and 3 described above illustrate the case where the operation unit 70 receives selection of two of the multiple virtual buttons corresponding to the lateral air flow directions. In some embodiments, assuming that, for example, the number of virtual buttons that are selectable is four, the left lateral air-directing vane 14 and the right lateral air-directing vane 15 are operated on the basis of two virtual buttons selected previously, and after a lapse of a predetermined period of time that can be set to any value, the left lateral air-directing vane 14 and the right lateral air-directing vane 15 are operated on the basis of two virtual buttons selected subsequently. Such a configuration can meet user's needs, such as a desire to be exposed to direct air flows immediately after, for example, coming back home or taking a bath, and change the air flow pattern to the swing operation after a lapse of a predetermined period of time. Specifically, the remote control device 40 may receive selection of three or more of the multiple lateral air flow directions, the three or more of the multiple lateral air flow directions including double selection of three of more of the same one of the lateral air flow directions.

Embodiments 1, 2, and 3 described above illustrate the case where the indoor unit 10 includes the single fan 20. In some embodiments, the indoor unit 10 includes a fan 20 for the left partial air flow and another fan 20 for the right partial air flow. The operation unit 70 may be configured to display an air flow velocity setting screen for each of the left and right partial air flows such that the velocities of the left and right partial air flows can be individually set in a manner similar to setting of air flow directions.

For the sake of convenience, the terms "forward path" and "backward path" are used for explanation of the operations of the left lateral air-directing vane 14 and the right lateral air-directing vane 15 in Embodiments 1, 2, and 3. In some embodiments, each of the left lateral air-directing vane 14 and the right lateral air-directing vane 15 starts its operation in the "backward path" in the above description. In other words, the operation timing of the left lateral air-directing vane 14 and that of the right lateral air-directing vane 15 may be adjusted such that the left and right partial air flows do not collide with each other.

Furthermore, the display screens of the operation unit 70 are not limited to the examples illustrated in the drawings. For example, a combination of solid letters and outlined letters may be displayed. For example, the item display section 71, the OK button 750, and a check mark may be displayed in an outlined manner. In addition, the operation unit 70 may have a function of changing the display state of a virtual button to an outlined display state in addition to displaying a check mark on the virtual button in response to receipt of a user's touch. Furthermore, the operation unit 70 may have the functions of the operation button unit 50, such that the remote control device 40 can exclude the operation button unit 50.

The invention claimed is:

1. An air-conditioning apparatus comprising:

an indoor unit including a pair of lateral air-directing vanes each configured to adjust an orientation of an air flow blown from an air outlet in a lateral direction; and a remote control device configured to receive at least two selections of air flow direction among a plurality of air flow directions in the lateral direction, the pair of lateral air-directing vanes including a left lateral air-directing vane arranged on a left side in a front view, and a right lateral air-directing vane arranged on a right side in the front view, wherein the indoor unit includes an indoor-unit controller configured to individually adjust the left lateral air-directing vane and the right lateral air-directing vane in accordance with the at least two selections, the indoor-unit controller is configured to perform control such that an orientation of the left lateral air-directing vane is a same as an orientation of the right lateral air-directing vane or such that the left lateral air-directing vane is further tilted to a left than is the right lateral air-directing vane, the remote control device includes an operation unit configured to display a plurality of virtual buttons each indicating a corresponding one of the plurality of air flow directions in the lateral direction and configured to receive at least two selections among the plurality of virtual buttons, the at least two selections include a double selection of a same one of the virtual buttons, the indoor unit controller is configured to recognize the double selection of the one of the virtual buttons as a different instruction than a single selection of the one of the virtual buttons, and the controller is configured to recognize that the double selection of the same one of the virtual buttons is an instruction to apply the same air flow direction to both of the left lateral air-directing vane and the right lateral air-directing vane.

2. The air-conditioning apparatus of claim 1, wherein the plurality of air flow directions in the lateral direction includes a left oblique front direction, a front direction, and a right oblique front direction.

3. The air-conditioning apparatus of claim 2, wherein the plurality of air flow directions in the lateral direction includes a front left direction between the left oblique front direction and the front direction and a front right direction between the right oblique front direction and the front direction.

4. The air-conditioning apparatus of claim 1, wherein the remote control device is configured to receive a selection of one of a left swing operation and a right swing operation.

5. The air-conditioning apparatus of claim 4, wherein, when selection of one of the left swing operation and the right swing operation is repeated in the remote control device, the indoor-unit controller is configured to perform control such that the left lateral air-directing vane and the right lateral air-directing vane swing in a same direction.

6. The air-conditioning apparatus of claim 4, wherein, when the left swing operation and the right swing operation are selected in the remote control device, the indoor-unit controller is configured to perform control such that the left lateral air-directing vane and the right lateral air-directing vane swing in opposite directions.

7. The air-conditioning apparatus of claim 4, wherein, when the left swing operation and the right swing operation are selected in the remote control device, the indoor-unit controller is configured to perform control such that the left lateral air-directing vane and the right lateral air-directing vane swing in the same direction.

8. The air-conditioning apparatus of claim 1, wherein the indoor unit includes an indoor-unit memory configured to store air-directing control data in which combinations of at least two of the plurality of air flow directions that are selectable in the remote control device are associated with the operations of the left lateral air-directing vane and the right lateral air-directing vane, and wherein the indoor-unit controller is configured to check each of the plurality of air flow directions selected in the remote control device against the air-directing control data and determine the operations of the left lateral air-directing vane and the right lateral air-directing vane on a basis of the air-directing control data.

* * * * *